United States Patent [19]

Perrine

[11] Patent Number: 5,072,743

[45] Date of Patent: Dec. 17, 1991

[54] BARRIERIZED CIGARETTE

[76] Inventor: Charles P. Perrine, 2534 Terrace Rd., Fort Wayne, Ind. 46805

[21] Appl. No.: 336,443

[22] Filed: Dec. 31, 1981

Related U.S. Application Data

[63] Continuation of Ser. No. 925,429, Jul. 17, 1978, abandoned.

[51] Int. Cl.[5] ..... A24B 3/02

[52] U.S. Cl. ..... 131/360; 131/365

[58] Field of Search ..... 131/365, 349, 360

[56] References Cited

U.S. PATENT DOCUMENTS

| | | | |
|---|---|---|---|
| 1,555,320 | 9/1925 | Weil | 131/349 |
| 1,996,002 | 3/1935 | Seaman | 131/349 |
| 2,666,437 | 1/1954 | Lattof | 131/349 |
| 3,102,543 | 9/1963 | O'Siel | 131/349 |
| 3,183,914 | 5/1965 | Cohn | 131/352 |

FOREIGN PATENT DOCUMENTS

| | | | |
|---|---|---|---|
| 0294038 | 7/1928 | United Kingdom | 131/362 |
| 1213828 | 11/1970 | United Kingdom | 131/365 |

*Primary Examiner*—V. Millin

[57] ABSTRACT

Differentiation of surface is utilized for the prevention or arrest of forward finger edge slippage along the surface of a cigarette under new perception and consideration of all significant factors, including the human factor. Provision is sometimes included for automatic extinguishing of the cigarette or destruction of its smokable utility prior to dissipation of the means against slippage. A cigarette is manufactured having predetermined control against its being smoked or burned the full length of its tabacco content. Means employed are varying adaptations of physics and chemistry but basic is either the principle of smothering or the utilization of combustion itself, or its product heat, in self defeating adaptation.

20 Claims, 3 Drawing Sheets

BARRIERIZED CIGARETTE

This application is a continuation of application Ser. No. 925,429, filed July 17, 1978, now abandoned.

SUMMARY OF THE INVENTION

The invention in one form provides a cigarette barrierized against and restraintive of the several hazards forward finger edge slippage along the surface of a cigarette and to its burning end, smoking of a cigarette down too far rearwardly for the better interests of health, and prolonged life or exposed condition of the burning end of a cigarette after such cigarette has been discarded without full extinction of its burning process. The prime objects of the invention are thus the prevention or arrest of this forward finger edge slippage, automatic regulation of the smoker's usage of a cigarette and in a manner reducing its long range risk to health, and a cigarette of construction less likely to initiate fires. Another object of one version of the invention is the reduction of tar and nicotine delivered to the smoker during a particular period of the act of smoking. Other objects of beneficial contribution will become apparent as the disclosure unfolds and they are of one specific characteristic—the accomplishment of the prime objects stated without introduction of certain undesirable features in consequence.

Figure 11A:
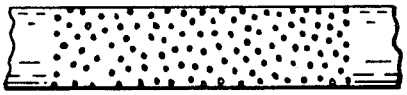
Figure 11B:
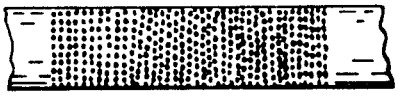
Figure 12A:
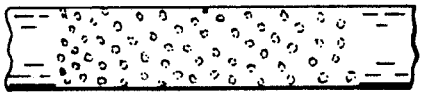
Figure 12B:
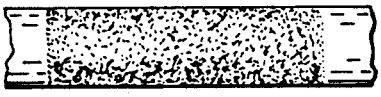
Figure 13:
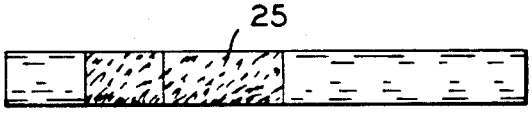
Figure 14:
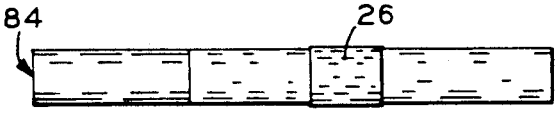
Figure 15:
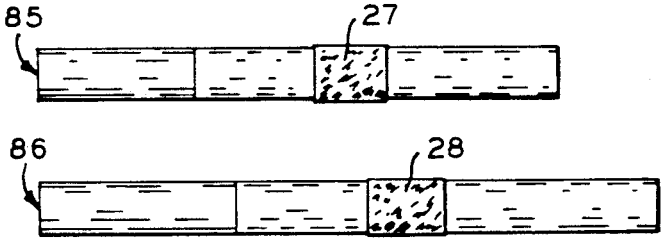
Figure 16:
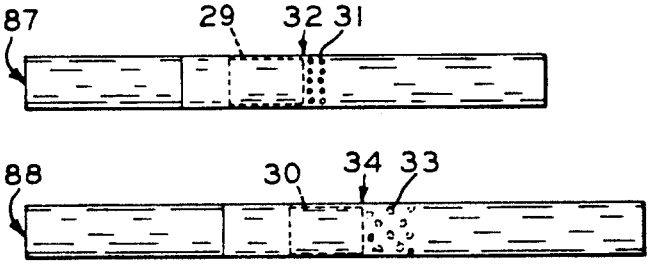
Figure 17:
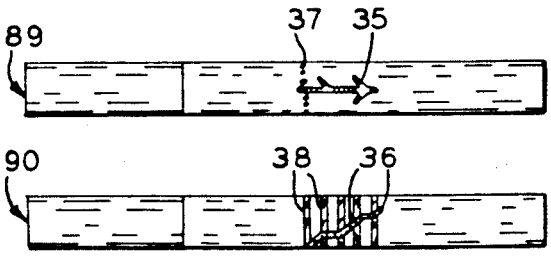
Figure 18:
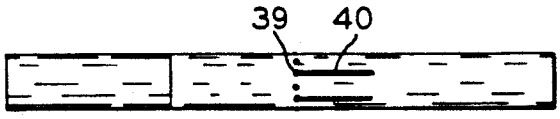
Figure 19:
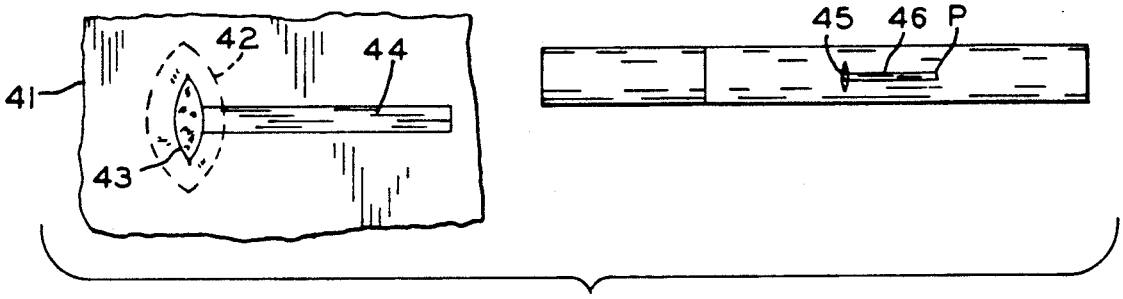
Figure 20:
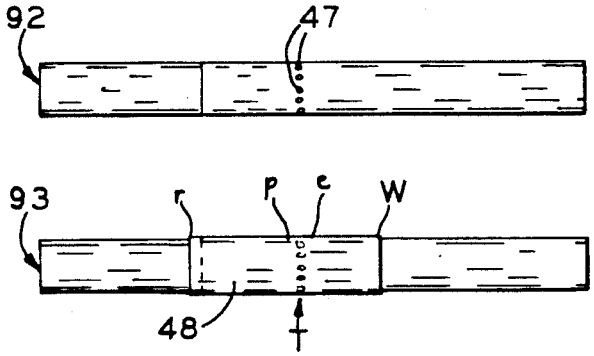
Figure 21:
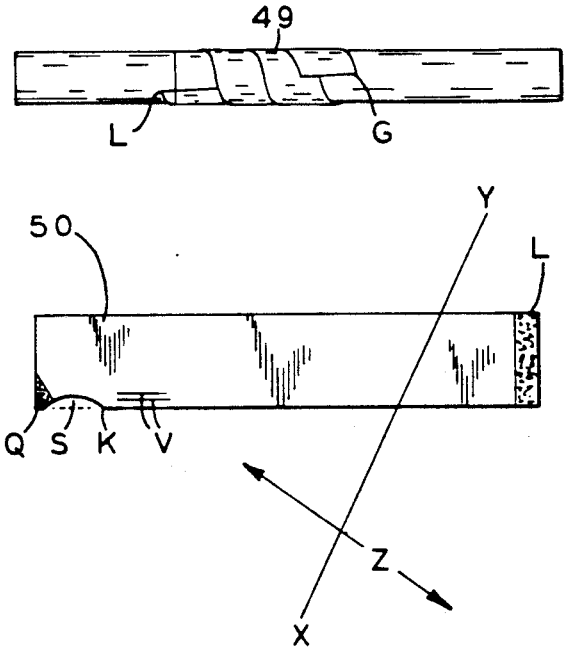
Figure 22:
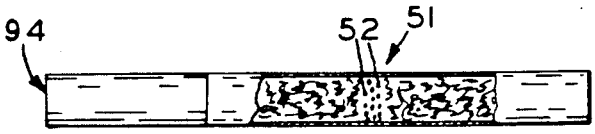

FIG. 11*b* is a similar view showing close, regular hold section of a cigarette characterized by wide, irregular spacing of "narrow" radial surface extensions and, FIG. 11*b* is a similar viem showing close, regular spacing of same;

FIG. 12*a* is an enlarged longitudinal view of a finger hold section of a cigarette characterized by wide, irregular spacing of "broad" radial surface extensions and FIG. 12*b* is a similar view showing close, regular spacing of same;

FIG. 13 is full length view of a cigarette having tackified finger hold section as means against forward finger edge slippage;

FIG. 14 is full length view of a cigarette having one form of Preventive Section Burn Barrier;

FIG. 15 shows full length view of 84 millimeter and 99 millimeter cigarettes each having Preventive Section with forward finger edge slippage preventive means and Burn Barrier means located concomitantly and reciprocally upon the cigarette;

FIG. 16 shows full length views of 84 millimeter and 99 millimeter cigarettes each having forward finger edge slippage preventive means and Burn Barrier means comprising Preventive Section of a cigarette but not located concomitantly and not located reciprocally;

FIG. 17 shows full length views of two cigarettes each having another form of Burn Barrier, each having also Preventive Section means against forward finger edge slippage and each having said Burn Barrier and anti slippage means located for reciprecal function;

FIG. 18 is full length view of a cigarette having another form of Burn Barrier and Preventive Section means against forward finger edge slippage adapted for reciprocal function;

FIG. 19 is, at 91 generally, a full length view of a cigarette having still another form of Burn Barrier, and is, at 41 generally, an enlarged depiction of a portion of cigarette enwrapment paper showing manufacture upon said paper prior to conformation of a cigarette but eventually productive of the Burn Barrier depicted on cigarette 91;

FIG. 20 shows full length views of a cigarette in two stages of manufacture illustrating in end result still another form of Burn Barrier upon a cigarette;

FIG. 21 depicts at 49 generally a sheath upon a cigarette accomplishing in another way a necessary feature of the cigarette of FIG. 20 and at 50 generally is shown the nature and composition of said sheath before enwrapment around the cigarette;

FIG. 22 is translucent full length view of a cigarette depicting an internally accomplished Burn Barrier.

DISCLOSURE AND SPECIFICATIONS

It will be found that throughout this disclosure there are interspersed requirements for expansive analysis of supposedly ordinary matters. Simple mechanical movements and relationships sometimes seem inordinately complicated. It will be understood we are dealing with and this invention relates to an interface between man and machine and an interface sufficiently obscured, apparently, as not to have been successfully attended heretofore. It is known that man has inexplicable, unpredictable spontaneities and ommissions. In his handling of any object man can be viewed, propositionally, as a reciprical component within a total machine, which machine has motion, broad range of operation and effect, and a uniquely unlimited self generating energy source. In this view man can be further seen as that component of such a machine as has essential dominance, least predictability and, greatest potential for malfunction, so that the engineering of all other parts of the machine toward controlled, responsive regulatory interaction with that most unstable central mechanism, man himself, is not a simple matter that can safely be left to ready supposition. This propositional view of man in relation to the objects he handles must ultimately be adopted if an object for the service of man is to be manufactured with bias toward man's safe and best utilization thereof.

Figure 2:
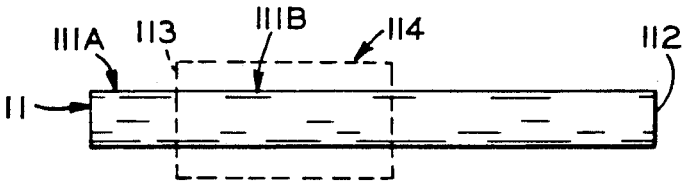
FIG. 2 is full length view of a conventional cigarette depicting conventional sectional portions thereof.
Figure 2:
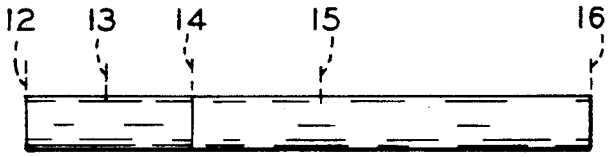
Figure 3:
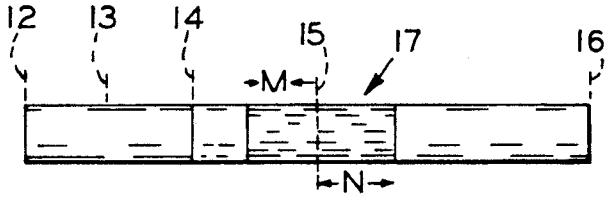
FIG. 3 is the same view as FIG. 2 with additional depiction of the relative location of this invention's Preventive Section.

Accordingly, and because certain versions of my invention relate to and employ conceptualizations and identities not found within the present and prior art, it will assist in this disclosure to first review, define and establish certain things of a general nature which are already known, recognized or at least utilized in the art and then next to present those new concepts and identities which, although also of a general nature once conceived and understood, I have failed to find acknowledged or considered within the art up to the present time. Thus FIGS. 1 and 2 in the drawings serve to illumine my textual review of the present art. FIG. 3 serves to illumine those new considerations involving the art which I present and in the light of which my invention can best be understood and perceived. The afformentioned FIGS. 1, 2, and 3, in combination with the textual references thereto, also establish a nomenclature then used throughout the disclosure to present my invention in clear and easily understood terms. FIGS. 4 through 13 in the drawings depict some of the preferred forms of the invention, all of which embody either centrally or exclusively the stated object of restraint against forward finger edge slippage. FIGS. 14 through 22 in the drawings depict preferred versions of those forms of the invention embodying stated objects other than exclusively that of restraint of finger edge slippage.

Figure 1:
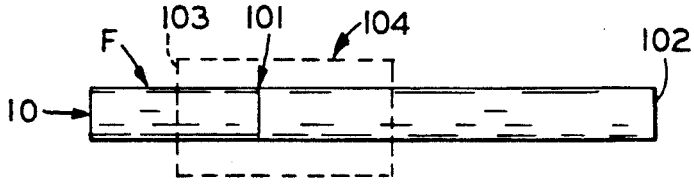
FIG. 1 shows full length views of a conventional filter cigarette and a conventional non filter cigarette and assists textual comparison of the two.

Referring now to FIG. 1 we depict a conventional filter type cigarette 10 and a conventional non filter type cigarette 11. In cigarettes of today the filter type cigarette is filled with tobacco or similar smokable commodity within a longitudinal section approximately depicted by line 101-102, but that remaining section F wherein is located the filtering means is not ordinarily filled with tobacco or other smokable commodity, whereas in non filter type cigarettes today the entire length 111A-112 of the cigarette is filled with the tobacco or other smokable commodity. However, in today's cigarettes of either kind, filter type or non filter type, that longitudinal section of a cigarette shown in the drawings by superimposed dots 104 and 114 is typically employed by virtually all smokers as a holding area for the thumb and fingertips or, more commonly, for the siderial edges of two holding fingers. The idiosyncracy of very occassional smokers departing from this norm notwithstanding, the overwhelmingly typical employment of the area indicated by 104 and 114 for the purpose stated, holding of a cigarette between a smoker's finger edges, and the said employment of said area to the virtual exclusion of all other areas will be solidly demonstrated by any empirical research among multitudes of smokers. It will also be understood that as regards non filter type cigarette 11, area 114 depicts a section the more shortly distanced from the inhaling end of a cigarette no differently than is the case in the more obvious relationship of area 104 in the case of cigarette 10, it being understood that in the case of a non filter or non tipped cigarette the inhaling end is indeterminable except as it is established at the time of lighting up of the cigarette via the happenstance of the smoker arbitrarily so selecting one end of the other of the cigarette. In the drawings we consistently adopt the left hand facing portrayal of a cigarette as its inhaling end.

Now between points 101 and 103 of cigarette 10 there is not tobacco filling, but between points 111B and 113 of cigarette 11 there is tobacco filling, yet the longitudinal area of a cigarette approximately delineated by line 101-103 in the case of a filter type cigarette and the longitudinal area of a cigarette approximately delineated by line 111B-113 in the case of a non filter type cigarette we believe it to be well accepted and concedable within the art are essentially of identical location, functional purpose and result except purely for the altered filtering characteristic of the filter type as against the non filter type cigarette. Or, more specifically and perhaps more unequivically this is to say the small additional length segment of tobacco filling in segment 111B-113 in cigarette 11 (non filter type) no more than all of 111B-111A in cigarette 11 is neither intended nor except in the extremest most untypical cases factually employed by the smoker as an extended length of consumable product available in cigarette 11 over cigarette 10. All practicalities of comfort and taste preclude this. Thus in the case of either filtered or unfiltered or untipped cigarette's of today's manufacture, a cigarette will be seen comprised basically of four interrelated longitudinal sections as shown in FIG. 2, where line 12-15 may be termed the over-all "utilizing section" of a cigarette, where line 14-16 may be termed the "production section" or the "consumable section" of a cigarette, where line 13-15 may be termed the "finger hold section" or "holding area" of a cigarette, and where line 12-13 may be termed the "puffing section" or "lip hold section" of a cigarette. Small differences of measurement will of course be seen and expected to prevail through the individuality of human conception, but it will be clearly perceived that the component sections of cigarette's today, as just enumerated and described, exist, are commonly recognized, by utilization if not by designation, and are typically located essentially as herein depicted and without real distinction as between filter and non filter cigarettes. In our continuing disclosure, using as we will the just introduced terms, the preceding textual discussion in combination with the drawings to which it refers will provide a nomenclature descriptively and locationally explicit. It is also well at this point to establish the intended meaning of two words having locational or directional significance which will be used frequently, "rearward" and "forward". By rearward we shall mean nearer to or moving toward the inhaling or puffing end of a cigarette. By forward we shall mean nearer to or moving toward the lighted end of a cigarette.

What is not known, recognized or employed in the present or prior art is the existence of a sectional portion of a cigarette which will be seen to bear particular relation to my invention. As the disclosure proceeds it will become evident that such a sectional portion of a cigarette exists or does not exist according to whether a manufactured cigarette provided or does not provide one or more of certain of the novel means of the invention. For purposes of the disclosure we shall call this newly introduced portion of a cigarette the "Preventive Section" or "barrierized area" and we shall so refer to said section hereinafter. The applicant's preferred boundaries, and in any event the essential location of the Preventive Section are depicted in FIG. 3, which figure is a reconstruction totally and identically of FIG. 2 except for the additional depiction of Preventive Section at shaded area 17 and portrayal by arrows M and N of the fact and concept that the bounderies of Preventive Section 17 are not precisely restricted, that their rearward and forward limits may extend or contract according to discretionary options of a manufacturer or manufacturers of cigarettes who shall employ the novel devices of the invention and also according to the overall length of a cigarette, as will be evident eventually in the disclosure. Thus, and in any event, it will be clear the invention does not appropriate per se an area of a cigarette, nor is it intended to be limited to same except as provided in the claims. Insofar as location is involved with the novel means and device it will become clear that function is the arbiter of same, that location is restricted not in arbitrary view of a cigarette as geometrical figure but rather in consideration of requisite reciprocity among parts of a machine and in preservation the integrity of object, so that what the applicant shall present precisely as optimum engineering will not be seen to exclude from the invention's scope minor departures in measurement that may constitute either inferior or improved engineering toward relatively the same accomplishment of the same object. It will thus be understood the invention is intended to be limited not by preferred distances, sizes, shapes, patterns or materials suggested herein but only by the wording of the claims.

A prime object of most forms of the invention is the prevention and/or arrest of forward finger edge slippage. Since, although the phenomenon has for years commonly occured (not as readily, however, in the older days of the shorter 70 millimeter cigarettes, the reason for this being accounted later in the disclosure), finger edge slippage does not appear to have been explicitly recognized or effectively treated within the art up until now, it is useful now to precisely identify and define the phenomenon as occuring when "a smoker at conclusion of act or acts of puffing on a cigarette or in other circumstance having its inhaling end contained between his lips, with the cigarette grasped at its holding area between thumb and finger tips or between finger edges, intends and attempts to remove the cigarette from between his lips but instead inadvertently allows the finger edges, or other, to merely glide ineffectively along the perimeter of the cigarette until they reach and painfully contact the cigarette's burning end". It will to understood that finger edge slippage is sensibly deemed to occur when a sliding direction toward the ultimate outcome has commenced and that a completed progression of same to the terminal point—burning end—constitutes definition by degree with inclusion of hazard. Practically every smoker from among the numberless with whom I have discussed the matter has had this accident happen to its full extent and reacts to the subject not with indifference but with obvious unpleasant recall. Its basic undesirability is of course apparent, but a little reflection will establish much more—its risks to property, to personal injury, to life itself, not just the property, injury or life of the smoker but of those of others as well can be conceived by anyone, it being necessary to consider only that smoking is frequently indulged simultaneously with the operation of machinery imposing unlimited hazards in consequence the loss of personal control or composure, for example the case of a smoker driving an automobile or for that matter, the case of a passenger in an automobile whose unexpected behavior can well and fatally disrupt the operative abilities of the driver of the automobile.

Now although the prior art does not disclose knowledge or manufacture specifically directed against finger edge slippage (perhaps erroneously presuming it is presently contained, which it is not in any way), it is necessary here to present the real and underlying causes of the phenomenon is that one may clearly appreciate how incidental features within the present and prior art do not effectively deter the phenomenon even although at first thought they might, upon this general disclosure, be presumed so to do, if not by design then by happenstance. It will be apparent that a smoker does not INTEND to glide his finger edges along a cigarette into contact with its burning end. It is equally apparent the phenomenon does not occur through inherent slickness of a cigarette's perimetrical surface, else the phenomenon would be occuring regularly in a smoker's experience, much more frequently than is the case. Further, if the phenomenon were attributable to inherent slickness in conventional cigarette wrappings, then "cork tipping", which lies within the present and prior art, would, even although not specifically directed to the purpose, effectually prevent or arrest the phenomenon, which empirical experimentation will be found to readily demonstrate it does not so do. Further, were a "cork tipping" designed to prevent the phenomenon and were it to have any consistency in so functioning, such a tipping would have to be extended considerably further forward than it has presently or heretofore been extended, characterizing at least the total finger hold section and thereby in fact reaching well into the production or consumable section of a cigarette; yet even if unselected cork wrapping were applied over the entire length of a cigarette, smoking considerations of combustibility, taste, etc. aside, it would still fail to materially reduce the phenomenon of forward finger edge slippage and it would in virtually all cases fail to arrest the phenomenon once the phenomenon was set in motion, unless indeed it were selected in adoption of certain specific features to be described in one version of the present invention.

The foregoing is true because it will be found that forward finger edge slippage, as stated, is not the result of inherent character of the cigarette but is rather the result of some unnoticed change or changes in the smoker's personal state, be the change an over relaxed attitude of his holding fingers or, quite conversely, an over tensing of same, be it an over dry non-tacky condition of his finger edges, be it an over moistness of his lips, be it a general preoccupation with other matters or be it a combination of any or all of these or similar conditions. All of these can and surely have caused forward finger edge slippage, but probably the most frequently occuring cause is not precisely any of them, it being instead simply a lapse of normal synchronization among the several reciprocating mechanics of the human body involved in the supposedly simple act of puffing a cigarette, withdrawing the cigarette from between the lips and then inhaling the smoke. It can be empirically demonstrated that, although the latter two objectives are activated in near simultaneity, they are not quite so, and that 1. The withdrawal of the cigarette from between the lips is necessarily the prior accomplished objective but that, 2. nevertheless, intent to inhale initiates a split second preparatory type tongue and lip movement which is PECULIAR to the intent to inhale, which is just PRIOR, ordinarily, to active volition for removing the cigarette and which decompresses the lips REFLEXIVELY after puffing and considerably reduces the lip hold at this precise moment, and that 3. if a smoker, with cigarette between his lips, changes his intent—decides against puffing or inhaling—or if he alters his timing—attempts to remove the cigarette with lips still in the compressed attitude of puffing—thus in either or any manner avoiding normal, reflexive relaxation of the lip hold (the automatic relaxation is conditioned as a movement following puffing or an intent to inhale and may not be as strongly signalled in the far less frequently made decision to remove the cigarette without having just priorly puffed upon it), then on such occassions forward finger edge slippage is much more likely to occur, indeed probably WILL occur unless the smoker is functioning in a highly conscious, deliberate manner.

Finger edge slippage, it is to be remembered, occurs as an accident, not as a matter of course. Finger edge slippage occurs because the delicate balance between lip adherence and finger edge adherence to the circumferential surface of the cigarette, normally and subconsciously maintained by the smoker in favor of the finger edges, has been reversed. Thus the lips retain and do not easily release the cigarettes end, while the finger edges in consequence glide ineffectively along the cigarette's circumferential surface instead of carrying the cigarette forward and away from the lips as intended. What is therefore required to remedy finger edge slippage, it can now be understood, is preferably a barrier designed into the cigarette and located forward of its normal holding area, a barrier which will, by compensation, arrest the forward slide of the finger edges once the phenomenon, due to unsuspected and altered spontaneities or physiological conditions of the smoker, has commenced. Either such a barrier or, alternatively, reconstitution of the finger and/or lip hold sections themselves and in such a fashion as to prevent or at least contain finger edge slippage. My invention goes to both approaches, as will be seen in various versions of the invention herein presented. It will also be evident the invention is not intended to be limited to the specific exemplifying forms detailed herein, as substitution of materials, conformation, chemical treatments, degrees and minute locations could be presented interminably, but rather that it is intended the invention be limited solely by the claims. It will also be seen in the various means presented that the term "barrier" herein and hereinafter used is employed in that broad construction of the word as depicts a service or an effect, not in that more rigid construction as must imply in all cases a discernible physical radius easily seen and measured.

It is the applicant's belief that forward finger edge slippage in smoking is a safety hazard unattended and unrestrained in the present and prior manufacture of cigarettes and it is his further belief the phenomenon is a safety hazard of a very serious order, having for years and yearly caused needless death and other loss and calculated so to continue causing until restraint is incorporated into the designed manufacture of the product. In this last regard it is the applicant's expectation that government, by regulation, legislation or both will ultimately address itself to the problem, imposing upon the product minimum inclusion and standards of preventive means. But no such standards, regulation or legislation are extant today and thus it should be understood the applicant presents here a selection of sometimes dissimilar means for relieving the hazard of forward finger edge slippage, not all of said means equally provident but all of them the more or the less provident and thereby constituting novel and effective means over the art as it exists today. Since, however, the novel means are intended and disclosed for adoption and use by manufacturers of cigarettes, and since any such manufacturer in selecting a means would want to estimate its life in relation to possible future standards and requirements, the applicant believes it is a part of clear and complete disclosure to indicate at least generally his own evaluation of the variant innovative means of the invention. Thus those means disclosed in reference to FIGS. 4 through 8 of the drawings are, in the applicant's view, most optimumly restraintive of forward finger edge slippage, while those means disclosed in reference to FIGS. 9 through 13 are clearly and designedly restraintive of the phenomenon, yet they might not, in the applicant's view, be sufficiently so as to necessarily fulfill the requirements of future minimum standards.

Figure 4:
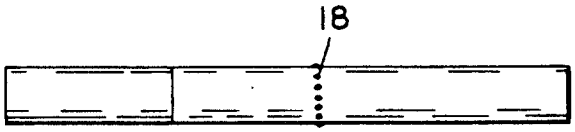
FIG. 4 is full length view of a cigarette having Preventive Section blister barrier.

In the drawings, FIG. 4 depicts a finger edge slippage barrier placed forward of a cigarette's holding area according to the invention, said barrier being composed of a circumferential ring (or rings, not illustrated) of radially extending convex blisters shown at 18. In operation, these blisters offer a raised surface against forward finger edge slippage, clearly and automatically reconstituting the frictional balance of lip and finger holds upon the cigarette in favor of the latter, sufficiently so as to cause the cigarette to be removed from between the lips as intended, when finger edges, previously and unintendedly gliding ineffectively along the holding area perimeter, reach and encounter said increased (compensating) resistance of the described radially extending blisters. Barrier 18 may of course be accomplished in the cigarette's manufacture either by making the blisters a feature of the paper or other substance directly enwrapping the tobacco content or by making the blisters a characteristic of a relatively narrow strip or band of additional or second layer wrapping suitably adhered to the cigarette at the functional point. In either event the manufacture of blisters upon paper will not be found sufficiently difficult to require manifold process details in this disclosure. To describe only one method, paper may be pressed between two plates, one of which has female indentations suitably located on its surface and the other of which has male or convex protrusions designed for fitting therein, so that when the two plates are firmly pressed together with the paper between them, and the condition maintained for a functional period of time, the paper will be permanently blistered. More sophisticated and assisting means may of course accompany the above basic formation process, such as, the concave indentations of the one plate or the convex protrusions of the other plate, or both, could carry a chemical coating or starching agent transferable to the paper so as to impart preturnatural stiffness and retentiveness of form to the blister conformations created, or the paper itself in the limited area to be blistered can first be treated with starching agent and the pressing of the paper between the two plates begun while the treated area of paper is not yet dry, and the entire process may be speeded and improved by varying uses of heat and/or air agitation. If blistered barrier 18 is accomplished by convex blistering of the wrapper directly next to the tobacco filling, and if the blisters are holiow rather than solid (it being understood that "hollowness" is not a requisite feature for accomplishing the barrier function—the radial extensions could be relatively solid in character, perhaps in that case more accurately called "pebbling"), then such blisters will also afford a filtering function, trapping an amount of tars and nicotine in their curved hollows, which tar and nicotine otherwise would continue in the direction of the smoker. Although this service will be operative without so providing, increased filtering effectiveness of the blister can be obtained by filling same with any actively filtering substance or inner webbing. It will be clear, however, that blistering applied only to a band of second layer wrapping and not to that material directly enwrapping the tobacco would constitute a means singly directed against finger edge slippage and without the filtering purpose or effect.

Figure 5:
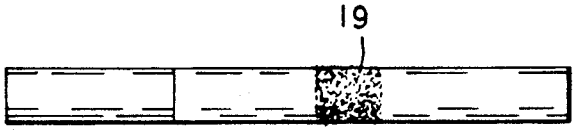
FIG. 5 is full length view of a cigarette having Preventive Section frictionalized or tackified barrier against forward finger edge slippage.

FIG. 5 depicts another kind of finger edge slippage barrier placed forward of the cigarette's holding area according to the invention. This barrier as depicted at 19 is attained in the manufacture of the cigarette by roughening the surface of the cigarette's wrapping at the intended location of said barrier, thus giving the Preventive Section of the cigarette a more frictionalized surface texture than the areas rearward of it. Such a roughened character could be imparted to the paper directly enwrapping the tobacco or it could be imparted to a relatively narrow ring or band of second layer wrapping suitably adhered to the cigarette at the functional location. In either case the roughened characteristic could be accomplished by any variety of means—scratching or crinkling of the paper, adherence thereto of many tiny sand-like particles, chemical coating of the paper with a tackifying substance, or even a very strongly raised circumferential printing of the brand name or other legend or design at this location are some which come to mind. Although process of manufacture nor materials of composition (except where stated in the claims) are not in this application intended as substance of the invention, representative methods are here offered such as, for a sandpaper-like slippage barrier, the coating of the paper prior to cigarette conformation and in the desired functional area with a fully hard drying glue such as model airplane mucilage or the familiar Elmer's household glue and the suitable sprinkling thereover before the glue shall dry of suitably selected grains of sand or other particalized substance rendering permanent frictional character to the treated area. The specification of chemical coating of the paper with a tackifying substance is herein expressive of a very broad class of available methods electible and contemplated within the inventive concept for establishing functional if not always easily discerned differentiation of surface between the regularly contacted finger hold section of a cigarette and any area forward of said section which shall be rendered arrestive of forward edge slippage. It is importantly understood, and it is a part of this disclosure to make clear, that the holding of a cigarette between finger edges while withdrawing it from between the lips is undoubtedly among the most delicate and light of all tactile functions performed regularly and routinely by ordinary, average persons. As to forwardly placed means of arresting finger edge slippage, the change from present, conventional cigarette's, which neither have nor purport to have any such means whatever, to a new genre of cigarette which does and intendedly does have effective means to the object, may well, under rather sophisticated approach involving original manufacture of the cigarette enwrapment material itself, produce a slippage barrier barely apparent to the eye, indeed, a barrier which, although eminently effective to the purpose, may nonetheless appear to persons specifically uninformed as surely insufficient to the object. In this class and resident in the invention are such paper processing resorts as reducing or eliminating entirely the sizing operation on cigarette paper, in manufacture and upon at least one side of the paper at the contemplated location of a forwardly located slippage barrier so as to result in an uncalendered or very lightly calendered in the nature of newsprint and pulp magazine paper, or altering the sizing treatment at said location to impart a surface texture in the variant natures of wax paper or an oil painting or art paper or blotter paper or some inks when laid on in close screen texture. Any coating or any process (including printing process) or any ommission of process which will render the cigarette enwrapment paper in the specific area—at least its outer surface—of softer or more porous character compared to the rather non-porous, glassine finish of cigarette paper generally, is capable, with close manufacturing engineer regard the object, of rendering the invention in effectively functional degree. As extreme example of tackification one may apply to the subject area of a cigarette a light coat of corn syrup. As less extreme example one may similarly apply a light coat of glycerine emollient. It will be found that either will impart a lasting quality of "tackification" effective against finger edge slippage. In the case of glycerine it will be found that, after the application dries, the cigarette surface nevertheless retains in the area a softer finish, if only just distinguishable, yet, and more importantly, effective UPON the finger edges in tangential movement even although not necessarily discernable to the touch of fingers generally. If it be found desirable to substantially reduce incidence of and disasters consequent the phenomenon forward finger edge slippage in the smoking of cigarettes, the range of available means will be found open to very minimal industry cost as well as without necessary imposition of packaging alterations. In the claims, differentiation of surface will be intended to include processes of "tackification" and where specifically used in the claims the word "tackification" will refer to all the concepts disclosed in this paragraph.

Any second layer band of wrapping at the functional location, surface texture notwithstanding, could serve as means if its thickness were sufficient to present a braking radial ridge to finger edges slipping forwardly along the cigarette, as it will be understood the triad balance between cigarette resistance, lip hold and finger hold which permits or arrests finger edge slippage is a delicate one and preventive measure is available through means which may be either the more or the less physically apparent. In this connection it can be noted the blister barrier of FIG. 4 is shown having a more narrow longitudinal extension along the cigarette than the roughened or frictionalized barrier of FIG. 5, depicted with a wider longitudinal identity. It will be understood the invention is not meant to be limited to specific measurments, shapes or configurations except as may be particularized in the claims. As a practical matter it is simply pointed out that, generally, that barrier which is a means more through evident radial extension can, if desired, employ a more limited lateral extension, while that barrier which is a means mostly through its frictional characteristics may need to be extended moderately in its lateral range along the cigarette.

Figure 6:
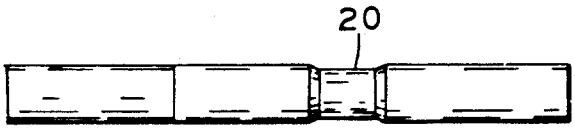
FIG. 6 is full length view of a cigarette with Preventive Section depressed barrier against forward finger edge slippage.

FIG. 6 depicts another form of finger edge slippage barrier shown at 20 and placed forward of the cigarette's holding area according to the invention. This barrier is in the form of a circumferential or semi-circumferential depression manufactured into the cigarette within its Preventive Section and forward of the finger hold area, and such a depression would be substantially as effective against forward finger edge slippage as a blistered or frictionalized surface. This is because the finger edges, parted sufficiently to accommodate a cigarette, are muscularly "working", and a sudden reduction in the diameter of a held object will have the same basic effect as any dissipation of opposition to a force of energy or gravity—the finger edges will "drop into" the gully and also (next) resist its forward ridge, causing sufficient break in the finger edge glide, sufficient opposing force to the lip hold as to remove the cigarette from between the lips as intended. Such a depression, to outline only one of numerous processes of manufacture, could be preset in the manufacture of cigarette paper itself, one or more tucks being made and glued vertically at the proper longitudinal location for the rearward terminus of the depression and then, suitably forward, one or more tucks being made and glued vertically at the proper location for the forward terminus of the depression. When these tucks, described from the perspective top surface of the paper (eventual outer surface of cigarette) and perspective left to right equalling rearward to forward ends of a cigarette eventually to be formed, are made in the sequence—upward fold to the right, spaced relation, return fold to the left comprising one single accomplished tuck constituting rearward terminus of the eventual depression—and then in suitably spaced relation forward (to the right)—upward fold to the left, spaced relation, return fold to the right comprising one single accomplished tuck constituting forward terminus of the eventual depression—the top surface of the paper (eventual outer surface), each tuck having been made secure and permanent by gluing, will be found to have been manufactured with a depressed area which will circumferentially obtain upon the cigarette when it is formed in cylindrical manufacture. It will be understood the preceding forming instructions have been made on the basis of a depression having depth of one tuck of the paper and that depths of two or more tucks made concomitantly atop one another could be utilized if desired.

Figure 7:
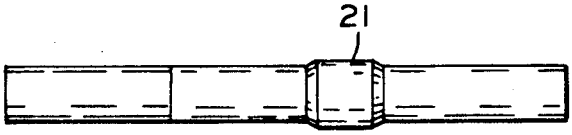
FIG. 7 is full length view of a cigarette having raised or swollen barrier against forward finger edge slippage.

FIG. 7 depicts still another form of finger edge slippage barrier shown at 21 and placed forward of the cigarette's holding area according to the invention, in this case a moderate swelling of the configuration of a cigarette accomplished at manufacture and in the cigarette's Preventive Section. Such a swelling could, among other ways, be preset into the manufacture of cigarette paper itself in much the way just earlier described for accomplishing a depressed barrier, the difference being essentially a reversed process. Thus, given the same described perspectives (top surface of the paper, and left to right longitude comprising rearward to forward bias of cigarettes eventually to be manufactured), the forming sequence would be as follows—upward fold to the left, spaced relation, return fold to the right completing one single accomplished tuck constituting rearward terminus of the eventual swelled or raised area—and then in suitably spaced relation forward (to the right)—upward fold to the right, spaced relation, return fold to the left completing one single tuck constituting forward terminus of the eventual swelled or raised area—the top surface of the paper, each tuck having been made secure and permanent by gluing, now having raised area which will circumferentially obtain upon the cigarette when cylindrically formed in manufacture. And of course multiple, concomitant tucks may be used for greater rise if desired. Also, a series of raised tucks spaced closely togehter along cigarette paper as a process of manufacture thereupon would create on a completed cigarette a longitudinal area of resistant ridges which would effectively implement the invention, either in the Preventive Section now under discussion or, as a matter of fact, in and according to the more demanding requirements which fairly limit means within the finger hold section of a cigarette, next to be outlined in this disclosure and specification. Of course if desired a swelled or raised area could continue forwardly uninterrupted to the cigarette's lighting end and still be functionally effective of the object as, as a matter of fact, so could any previously described remedy except possibly the remedy of surface depression. In operation, all of the barriers shown in FIGS. 5 through 7 function ultimately the same as described in reference to the blister barrier of FIG. 4.

It will be seen that provision for a barrier against forward finger edge slippage already commenced inherently involves that portion of a cigarette's Preventive Section as is seen forward of line 15 in FIG. 3. Portions of the Preventive Section of a cigarette which locate rearward of line 15, if they are so located at all, will be shown later in the disclosure to relate to other objects of the invention, but insofar as the Preventive Section of a cigarette is concerned with forward finger edge slippage such section will best not extend rearward of line 15, as rearward of line 15 any restraint upon forward finger edge slippage should belong to and comprise the finger hold section of a cigarette, or it may belong to the lip hold section, or it can reside in reciprocal features of both of these sections. Protection against forward finger edge slippage, when such protection is located in the Preventive Section, is an "arresting" process. That alternative (or possibly supplementary)approach to the problem which involves redesign of or altered characteristics within the utilizing section of a cigarette, either the lip hold section or the finger hold section or both, can be properly recognized as and termed an "inhibiting" process—that is, the main thrust being to inhibit commencement of any finger edge slippage in the first place. There are some possibilities in this approach, but the applicant believes these to be, with one exception, fundamentally inferior to an arresting process as regards reliability. The one exception, embodied and depicted in FIG. 8, is thus now disclosed last among those means presented as optimumly restraintive of forward finger edge slippage, while other possible embodiments of the inhibiting approach to the problem, having in the applicant's view a somewhat reduced reliability, are subsequently grouped together in reference to FIGS. 9 through 13.

Figure 8:
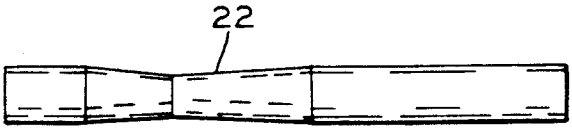
FIG. 8 is full length view of a cigarette having a finger well in its finger hold section.

In FIG. 8 is depicted a circumferentially recessed finger well or finger hollow, shown at 22 and manufactured into the holding area of a cigarette according to the invention. Indeed the exact contour, slope, degree of depression, and to an extent the over all length of area depressed are relatively electable matters open to the cigarette manufacturer. Experimentation will disclose that almost any expression of this concept which is designed under due consideration of its functional purpose will adequately serve. Such a finger well can be manufactured upon either a filter type or non filter type cigarette. For filter type cigarettes the circumferentially recessed area could be a molded characteristic of the filtering element itself. Manifestly, however, the filtering element in such a case would thereby be somewhat elongated by comparison with filtering elements typically employed today, extending forwardly further toward the cigarette's consumable section than filters now do, but this, on the other hand, does not necessarily mandate that the longitudinal increment of the element actually have filtering characteristic, since of course the added length of the element could be only appended structure offering framework and otherwise not filled or, as a matter of fact, otherwise filled with tobacco. In any event a finger well manufactured into the holding area of a cigarette is one of the inventions preferred novel means against finger edge slippage and such a means would prove optimumly effective of the purpose. In operation it will prove virtually impossible for a smoker's finger edges to escape the confines of such a finger well even although its altered diameter be only quite fractional without automatically accomplishing the intended removal of the cigarette from between the lips. The depressed finger well 22 of FIG. 8 is depicted as retaining, circumferentially, a basic cylindrical convexity because there are requirements neither of comfort or function which preclude this, but it will be understood conformation is not thereby limited to said circumferential convexity, matters of shape not being a definitive feature of the invention. Also in the case of a finger well, and untypically as compared to other treatments confined to the finger hold section of a cigarette, some latitude may be considered for slightly foreshortening the forward extension of the well, this being a singular instance where the manufacture, by the suggestion of its conformation, might influence and alter the typical holding locations adopted by smokers of cigarettes. It is the applicant's recommendation, however, that over reliance not be placed on such projected influence and that ample experimental research among smokers be undertaken before electing to market as "preventively safe" a manufacture featuring a shorter finger well than shown in FIG. 8. Generally, for integrity of the functional object restraint against forward finger edge slippage and where means to the object are based within the finger hold section of a cigarette, means are best applied along the entirety of the finger hold section as established by line 13-15 of FIG. 2, not to just a portion thereof, and this will be more exactly understood in the light of examination of the finger hold habits of smokers, afforded subsequently in this disclosure. As to the methods of forming finger wells upon cigarettes, if, as in one specification shortly preceding herein the well shall be a molded characteristic of a filtering element, then the process is simply a matter of the shape of the die which manufactures the filter element or plug; if the well shall be manufactured upon a non filter cigarette, the instructions earlier given for forming a depressed area in the Prevertive Section by means of tucks made and secured in the cigarette paper can well be followed with elementary changes in the location and spacing of the tucks: if on a filter cigarette, it shall be preferred not to elongate and mold the filter element itself, then a tuck to comprise rearward terminus of the finger well can be a feature of the paper eventually to enwrap the filter element and a suitably located tuck of reverse bias to comprise forward terminus of the finger well can be a feature of the paper eventually to enwrap the tobacco content, so that when the filter element and the tobacco shaft are joined in manufacture the two described tucks will provide conformation of the desired finger well. It will be understood formation instructions given are representative but not limiting implementation of the invention—finger well in the holding area of a cigarette.

It is understood and recognized that finger wells are not uncommonly found in the related art of attachable smoking appliances such as cigarette holders. Study of the conformation of such finger wells, however, will disclose they essentially eliminate the convex nature of the appliance's perimetrical surface within the surface area so molded or hollowed out. This fact, combined with the usual hardness of the material out of which such holders are customarily made—a hardness which would be uncomfortable when long pressed in fully cylindrical contour against the thinly fleshed character of the human inner finger edges—strongly suggests the purpose and service of such finger wells on such appliances as having the object of physical comfort. Further weighting the same conclusion is the fact that cigarette holders, typically of a hard, unyielding surface composition as noted, would be uncomfortable to the puffing or holding lips if cylindrical conformation were left unmodified. It would appear for this reason that they are seen almost always to taper into a more flattened, elliptical configuration in the nature of a pipe stem and tip, as no other logical reason (than the hardness and discomfort of compositional material used) seems to present itself for this universal fact of pipe stems and attachable smoking appliance stems having evolved into forms tapering into no or significantly moderated convexity, whereas cigarettes themselves, of softer, more pliable character, have been well accepted and most popularly continued in their unmodified cylindrical form. The limited market acceptance of oval shaped cigarettes contrasted to the apparent public demand that pipes and attachable smoking appliances feature this reduced outer convexity in their puffing and finger hold sections (sections corresponding to the "utilizing section" of a cigarette) testify to this analysis establishing comfort as the object of finger wells in smoking appliances. But whatever the purpose or service of a finger well on a separate, attachable appliance, the service in such a case is clearly in relation to the appliance not in relation to the cigarette itself. Thus even if it could be construed (which applicant questions) that a recognized purpose of a cigarette holder is to provide against finger edge slippage, then still, a legitimate object of this invention is to obviate the need of cigarette holders for such a purpose. If using a cigarette holder is today requisite for avoiding a life involving hazard of a product handled by the hundreds of billions yearly then of course the hazard is in no way avoided by the product itself but is avoided only by chance or the minimal instances when a user of the product overcomes pervading human inertia, properly conceives the hazard, takes the unusual initiative to obtain, have and consistently employ a cigarette holder. It is surely apparent that any redesign of a primary product (the cigarette) which unobtrusively incorporates into that product, a structural security it never priorly had against a specific hazard, is novel and will not be found otherwise merely because physical or chemical principles utilized have been within man's ken for centuries.

Figure 9:
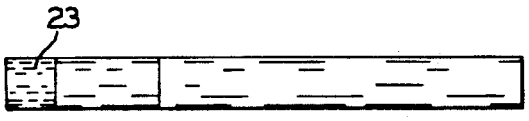
FIG. 9 is full length view of a cigarette having slickened lip hold section as means against forward finger edge slippage.

Returning now to other versions of the invention, FIG. 9 shows a foreshortened tipping, 23, on the inhaling end of a cigarette. Importantly according to best engineering of the invention, tipping 23 should be dually characterized, on the one hand by the essential slickness of its surface and on the other hand by its placement entirely rearward of the cigarette's holding area, such that the pressure points of the typically functioning finger edges, in holding the cigarette, will not be expected to contact said rearwardly placed area, which area, therefore, is precisely, exclusively and uniquely a lip hold section of the cigarette. Such a characteristic, a means—the slickness can be accomplished in any number of ways or treatments compositionally or chemically available today, but the slickness, to be functional must exceed that which now or has been applied integrally to cigarettes and it must comprise a surface highly repellent, not retentive to mucus. The applicant has found a diluted solution of one part 41 Baume sodium sillicate and two parts water as one coating which will effect functional slickness implemental the invention, rendered upon the lip hold section. Such a manufacture as depicted in FIG. 9 and just described will in operation and due to the slickness of said lip hold section in contrast with the more frictionalized finger hold section to a greater or lesser degree weight the balance between lip adherence and finger edge adherence to the circumferential surface of the cigarette in favor of the finger edges and in a measure independent of the smoker's own constant control and regulation of that balance, thereby serving as novel means to discourage the commencement of any forward finger edge slippage. The reader's recognition that the incident of forward finger edge slippage occurs or does not occur in result the predomination of one or the other of two opposing forces of relative opposite motion, the lips and the finger edges, with non occurance dependent on finger edge predomination, has here been assumed. But it is pointed out employment of the phrase "to a greater or lesser degree" and selection of the word "discourage" are by no means casual, but explicitly go to the basic inferiority of anti-slippage (other than finger well, and possibly tackification—a bastard means dealt with later but having serious drawback of other character) provisions based within the utilizing section of a cigarette as contrasted with those based within its Preventive Section. The inferiority exists, and for reasons unlikely to be fully compensated, which are:

1. The fact of the smoker rather quickly becoming accustomed to the difference between two surfaces regularly contacted and adjusting thereto in a way which tends to normalize and equalize said surfaces, thus reducing the effectiveness of their differentiation.

2. The fact there is a selectible limit to the slickness which can safely or desirably be imparted to the lip hold section. A slickness which denies any effective hold whatever to the lips would be both unsafe from other standpoints (smokers WILL endeavor to hold cigarettes between the lips without supporting fingers) as well as unacceptable to the smoker as a consumer.

Nevertheless, the means described in FIG. 9 is a form of the invention and will afford significant if only but relative effectiveness in restraint of forward finger edge slippage.

Figure 10:
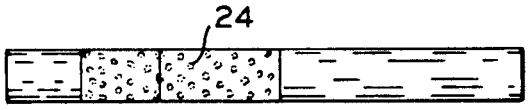
FIG. 10 is full length view of a cigarette with frictionalized finger hold section as means against forward finger edge slippage.

FIG. 10 depicts an altered surface, shown at 24, given to the finger hold section according to the invention and such as would be relatively effective against forward finger edge slippage and which depicts the applicant's best selected means for inhibiting finger edge slippage through the device of preturnaturally frictionalized surface rendured within the finger hold section, although any preturnaturally frictionalized surface there rendered will inherently have service as means to the object and will thus be seen within the scope of the invention. The cigarette's surface at 24, the finger hold section, is characterized by roughness, frictionalization, whether by blistering, pebbling, particalizing or whatever descriptive name or method might be applied, but the combined and important novel features are that the rendered manufacture indeed is functional recognition of the true and universally adopted areas of finger hold, such that characteristics with object can effect the object, not lose it in mislocation, that the rendered section is indeed different, in a functionally measurable way more frictionalized than the opposing lip hold section, and that its surface is not simply rough or frictionalized, but irregularly so and SPACEDLY so, this last factor being helpful to overcoming the penchant of human tactile functions for adjusting to, for accustomizing themselves to surfaces frequently contacted, just as it is also in other respects helpful to establishing, in the finger hold section of a cigarette, real, not merely presumed or appearance of restraint against forward finger edge slippage, all of which will now be made apparent.

In Figures generally 11 and 12 are enlarged representations of a cigarette's holding area through which we can illumine the principle of irregular, spaced frictionalization. FIGS. 12A and 12B depict roughening or frictionalization of surface accomplished by blistering, pebbling or other like means characterized by the fact the radially extended components of such surface each have an essential quality of breadth. To exemplify, let 1/32 inch be arbitrarily selected, purely for general classification purposes of this disclosure, as a minimum breadth of each of the radial extensions characterizing this, a class of structurally frictionalized surface which we shall call "course grained" and which is typified in both FIGS. 12A and 12B. Then FIGS. 11A and 11B by way of contrast depict roughening or frictionalization accomplished by prickling, sand sifting or otherwise particalizing a surface such as to give it a sandpaper like finish characterized by essentially a lack of breadth in the radially extended components thereof, each such having breadth of less than 1/32 inch, and this, then, is a class of structurally frictionalized surface which we shall call "fine grained", depicted in both FIGS. 11A and 11B.

Now the principle of irregular and spaced frictionalization as it pertains to the prevention of forward finger edge slippage along a cigarette and as it restricts and defines this favored novel version of the invention as depicted in FIG. 10 becomes manifest in the disclosure that whether or not a structurally frictionalized means applied to the finger hold section of a cigarette will be most effective against slippage rests not in an election between fine grained and course grained surfaces but rather in a proper selection of a sufficiently irregular and spaced application of the radii of any structurally frictionalized surface of whatever class to a cigarette's holding area, be such application fine grained in class, course grained in class or a combination of both classes. To illustrate, neither the surface depicted by 11B, a fine grained frictionalized surface, nor yet the surface depicted by 12B, a course grained frictionalized surface, will be found optimumly effective against slippage when utilized within the finger hold area of a cigarette, for reasons early to be disclosed herein. Appositely, however, either of the surfaces depicted in FIGS. 11A or 12A, again—the one employing a fine grain, the other employing a course grain—but each characterized by irregular and more widely spaced application, WILL be optimumly effective against finger edge slippage when utilized within the finger hold section of a cigarette and, again, for reasons now to be disclosed:

The close, regular spacing depicted in FIGS. 11B and 12B will not be optimumly effective because the finger edges, in repeated contact with such surfaces, become accustomed to whatever roughness or frictionalization pertains and thus adapt their applied pressure against such surfaces accordingly and in conformance with the well known fact that human mechanisms standardize in conditioned relation to that which is normal to them, that which is "normal" being in all reasonable instances equivalent to that which is frequently, routinely encountered. Thus, through such conditioned adaptation of the finger edges thereto, surfaces typified in FIGS. 11B and 12B can become not greatly more resistant to incipient finger edge slippage than the smoother surface of ordinary cigarette enwrapping material, to which the finger edges also adapt and accustomize themselves in a similar way. Further, surfaces such as depicted in FIGS. 11B and 12B, already just seen to lack optimum effectiveness against incipient finger edge slippage, (for reason of "regular" spacing) will be found to lack full arresting effect additionally for reason of the "closeness" of their spacing, a closeness, which offers to finger edges moving tangentially along such a surface only slight tactile differentiation between any two of the essentially equable areas of said surface. In this regard and in order to recognize the service of "tactile differentiation" it will be understood that arrest of forward finger edge slippage, while it usually will be found accomplished importantly through forces of physics operative independent of and regardless of such, nevertheless is also likely to be importantly abetted by swift, involuntary, signal induced reactions of the smoker—in other words by phenomena engaging physiological stimuli and response—where and if a stimulus type signal is available and operative. There can be no question that a designed manufacture to intensify a smoker's tactile differentiation of sectional surfaces of a cigarette could and will serve as an automatic signal that finger edge slippage is in process and there can likewise be no question, then, that a strong tactile differentiability of altered or alternating surfaces must prove contributory to the total potential of said surfaces for causing the arrest of forward finger edge slippage once commenced, the fact being apparent that it, due to a surface (as typified without directed exception within the art today or previously) lacking in design therefor, a smoker shall receive no or inadequate tactile signal of finger edge slippage in process, then he can and will make no involuntary, reflexive remedial response (such as an increased pressure of the finger edges, a breaking of the forward momentum of the hand, a loosening adjustment of the lips—and common knowledge of the human mechanism will not question that any of these reations may well occur, or indeed all of them co-occur in involuntary reflexive response to a tactile signal, so remarkably competent and swift is the uncontrolled "brain" of a living organism), whereas if such a signal indeed is received due to a manufactured surface designed therefor, it is a normal, usual and prdominantly reliable function of the human mechanism to initiate an involuntary, swift and remedial response.

Accordingly, surfaces such as depicted in 11B and 12B, although for possible uses other than the one at hand, restraint of forward finger edge slippage through means based in the finger hold section, they clearly do appear to be "frictionalized" in character, nevertheless can now be recognized and seen as not optimumly productive the object of this invention, as only moderately arrestive of finger edge slippage, and for dual reasons the one being that an ongoing instance of finger edge slippage over such surfaces produces insufficient tactile differentiation to induce the smoker's timely remedial action; the other being that these surfaces, because their depressed areas (texture characteristics) are quite miniscule in relation to the broader, relatively flat curvature of a finger edge, offer inadequate actual physical barrier to ongoing slippage, a physical barrier obtaining only if, in passing tangentially along a surface, the finger-edge curvatures can be expected to momentarily drop into and imbed themselves in a depressed area so that they will then resist the next radially extending point of surface, and it is evident the next "point" is "radially extending" (in a functional way) only to the extent a portion of the approaching finger-edge has attained a lower (deeper) plane than that of the extension's extremest physical radius. (The intermixed relations weight, gravity, tension, bulk, area, relative rigidity, shape and momentum all pertain in any complete scientific analysis of the relavent disclosure quite minuscule in relation to the broader, relatively flat curvature of a finger-edge, but it is felt so lengthy a treatment here will be unnecessary and that a reader will be able to appreciate and validate the point intuitively in his own empirical knowledge, noting two simple examples offered for the purpose: —(a) the natural anchorage of a conical peg in a hole, other things being equal, is the more secure according to the depth of its engagement therein, and the depth of its engagement therein is an accommodation of the diameter of the hole in relation to the expanding taper of the peg, and (b) it is well recognized that a 1" diameter hole of 8" depth in a roadway will exert little impedence against an automobile tire passing directly over it, whereas a 6" diameter hole of the same 8" or even considerably lesser depth will exert considerable impedence against an automobile tire so passing directly over it.)

Returning now to the figures of disclosure and comparison, FIGS. 11B and 12B in juxtoposition with FIGS. 11A and 12A will demonstrate the invention cannot best be fulfilled with any casual selection of roughened surface. FIGS. 11B and 12B depict surfaces which, although roughened or frictionalized and therefore capable of at least nominal and limited effect as means, will nevertheless not ideally serve as means for this version of the invention, a version employing means located within the holding area of a cigarette (surfaces less functional in the holding section may be quite adequate in the Preventive Section). Lacking here are the features irregular, widely spaced frictionalization, which features importantly supply both the physical and the phsiological restraint against finger-edge slippage. FIGS. 11A and 12A by contrast depict that genre of frictionalization which does best and most fully fulfill the invention, the surfaces therein portrayed being manifestly of more irregular and widely spaced character, those features requisite to and effectively supplying deterrence to forward finger edge slippage where said deterrence is elected to be a means located within and typifying the finger hold section of a cigarette. It will be apparent that no matter where the finger edges initially seat themselves within a cigarette's holding area, where said area is structurally constituted according to FIGS. 11A, 12A or 24 in FIG. 10 and thereby according to best implementation of the invention, they will, upon the slightest tangential movement forwardly, encounter not only a signal producing tactile differentiability of surface (thereby activating remedial reflexive physiological reactions of the smoker) but also they will encounter actual physical impedence due to the admissibility of the finger edge curvatures into the wider areas of depressed surface available therefor. It will be understood the surfaces depicted in FIGS. 11A, 12A and 24 in FIG. 10 are meant to be illustrative and expository, not precisely limiting, and that any variations substantially equivalent are assumed herein, the invention being limited only by the claims. As one variation having equivalence, for example, even close spaced radii as typified by 11B and 12B would be optimumly effective means if the application of such radii within the finger hold section were applied not solidly and equably but instead applied intermittently, such as in spotted patterns or in circumferentially striped patterns along the longitudinal surface of the finger hold section.

It should be noted in FIG. 10 that the finger hold section depicted extends forwardly for considerably greater distance than is seen in today's cigarettes if today's finger hold areas were to be accepted as delineated by filtering elements and the visibly different enwrapment surrounding them and that it likewise is cut short in rearward extension as compared to such delineation. All goes to the applicant's disclosure in FIG. 2, line 13-15, of the actual finger hold section of a cigarette as it is adopted and created in the practice of smokers everywhere. Visually seen differentiations of appearance as rendered in cigarette manufacture past and present, whatever significance or use may or may not be intended, simply do not relate in any way to finger hold usage and must be assumed to have no bearing in regard thereto. To forestall error in the future manufacture of device for preventing forward finger edge slippage it is here made clear that today's typical filter elements indeed do not run forwardly into the cigarette sufficiently far as to delineate, even approximately, an effective slippage deterrent, given that even the material enwrapping said elements were to be properly frictionalized according to this invention. That a rearward portion of a smoker's holding finger edges would appear to touch a forward extremity of a surface presumably intended as a slippage deterrent is insufficient and to infer operativeness on such a basis would be error. Clearly the points of applied pressure by the finger edges are what must be safely within the operating scope, range or area of such a deterrent. While these points vary according to the angle of tilt at which the cigarette is held and other factors, they nevertheless are governed and determined most heavily by the bone structure of fingers, which bone structure will be found to comprise a broadening bone radius toward the back (non-palm) circumferential surface of the fingers, which factor locates finger edge pressure points during the typical act of holding a cigarette—always well forward of the apparent (visual) finger edge center. Understanding this, to demonstrate that the visibly sectionalized lengths of cigarettes today (typically so sectionalized only via the coincidence of an additional layer of enwrapment applied around a filter element) do not comprise, even forwardly, let alone rearwardly, any accurate recognition or definition of a cigarette's true finger hold section and that, therefore, incidental surface characteristics of whatever kind rendered thereupon have not and would not constitute restraint upon forward finger edge slippage, either through design and recognition theretofor or even, otherwise, through happenstance, is a matter easily undertaken by any reader who smokes cigarettes, such a reader needing only to employ the following easy experiment:

Let a reader, if he will, smoke a filter (tipped) cigarette of today's manufacture, placing it between his lips and removing it eight or nine times in his normal fashion and without deliberation, probably placing it on an ash tray occasionally and picking it up again, but upon each removal of the cigarette from between his lips, studying and noting the location of his finger edges and particularly attending those points of obvious pressure sensation whenever he shall slightly compress his finger edges. Through this a reader will doubtless discover for himself that even the forwardmost portion of the filter tip area, and even if it were roughened or frictionalized, is sufficiently foreshortened as to be grossly unreliable for purpose of deterrence of forward finger edge slippage. That today's cigarette tips are not directed to the object of this invention will become apparent. Indeed that any roughage or frictionalization of today's cigarette tips tends toward counter productivity as regards an object of deterrence forward finger edge slippage will instead be apparent in that such frictionalization will be seen to insure to the lips a frictional increment while offering the finger edges only such ambiguous seating as may well result in their inferior hold upon the cigarette. In the experiment, of course, if the cigarrete is smoked down short enough, the smoker's finger edges will be found to eventually work themselves sufficiently rearward as to encompass their pressures about the not materially altered enwrapment typical of filter ends, but any improved frictional anchorage for the finger edges that might be immagined indeed comes far too late—at a time in the process of smoking a cigarette when forward finger edge slippage is least likely to occur—as will be disclosed eventually in reference to the old shorter length cigarettes having length of under 84 millimeters.

FIG. 13 depicts another way to render the finger hold section of a cigarette preventive against forward finger edge slippage according to the invention, the shaded area shown at 25 being chemically tackified. It will be noted that shaded area 25 depicts tackification of the entire area equably, but it will be understood tackification could be visible or otherwise and that it could be intermittent within the area in the form of spots or strips or any other configuration, but in such an election the forwardmost placement of tackified spots or stripes should of course attain at least the forwardmost location of typical finger hold usage. While tackification could be almost 100% effective as a slippage deterrent, for such reliability within the finger hold section problems and disadvantages pertain which are not similarly present with use of a tackification approach in the Preventive Section. It has been pointed out that "tackification" in the Preventive Section of a cigarette is not necessarily confined to means of noticeable or objectionable "stickiness", and this is true—"stickiness" need not be a discernible quality of even entirely adequate tackification in the Preventive Section of a cigarette. But effective means in the finger hold section must overcome that critical penchant of human faculties for adjusting and normalizing to surfaces of any tolerable kind regularly contacted, as has been dealt with in some detail earlier in this disclosure. Thus a somewhat noticeable degree of stickiness (such as found on postage stamps or gummed labels or envelope flaps) has, in the applicant's experience, been found requisite for tackification consistently functional within the finger hold section. As implementation the invention, tackification within the finger hold section becomes an election which may need to be undertaken with some considered compromise as between reduction of efficiency of means versus imposition in some degree of features unwanted from the standpoints of consumer acceptance and packaging.

Thus far in the disclosure we have presented various examples of means according to the invention for accomplishing the object prevention or restraint of forward finger edge slippage along the surface of a cigarette. These means have often but not always involved a relatively forward located section of the cigarette known, according to the invention, as the Preventive Section, said section constructively existing, however, only in relation to the invention itself since, without the service and means of the invention, the portion of the cigarette occupied would otherwise be recognized, if distinguished at all, as the production section or the consumable section of the cigarette, or at the least in terms of like meaning: Other stated objects of the invention already mentioned, automatic regulation of the smokers usage of a cigarette and in a manner reducing the long range risk to health inherent in the smoking of cigarettes, a cigarette of construction less likely to initiate fires will, in what follows and according to the invention, be seen to obtain through means located at least partially within this Preventive Section of a cigarette.

These two objects just mentioned above are accomplished according to the invention by incorporating into the designed manufacture of a cigarette and within its Preventive Section a Burn Barrier such as to render the cigarette essentially inoperative when its burning end shall attain the area of said barrier. Clearly a cigarette is "operative" or "inoperative" according to high convenience and satisfaction standards established today and demanded by smokers of cigarettes. The fact that a cigarette by manufactured design and according to this invention rendered "inoperative" at a given segment of its length (at a given point to where its burning end may recede) could again be rendered operative by a given smoker who chose to painstakingly nurse its burning process through and beyond said segment or who chose to cut away said segment and relight the cigarette for renewed consumption will not be deemed to render such a cigarette "operative" beyond its Burn Barrier point. What the invention's Burn Barrier does and is intended to do is simply to render the cigarette essentially unsuitable and unacceptable for further and ordinary smoking after the barrier point is reached, the terms suitable and acceptable being understood to have reference to normal standards and demands of normal smokers, not to those of a smoker who is for some reason determined to consume all of a cigarette regardless of all inconvenience and difficulty. It should further be made clear that the term "burn barrier" here adopted and used denotes, as will become apparent in the variant means to be disclosed, a contrivance related to the combustive and/or draw qualities of a cigarette and such as to render the cigarette, through those qualities or their effects, unsuitable for smoking, it being not necessarily required that a result or effect be one of total incombustibility.

Current and past practice in the art toward minimizing the health hazard of smoking cigarettes approaches the problem through reduction of the tar and nicotine deliverable by the cigarette. This approach invariably encounters the dilemma of either retaining in each manufactured cigarette a high health hazard potential or else reducing each individual cigarette to a placebo-like product which few smokers will accept and use. This invention approaches the problem in an entirely different way, on the one hand permitting different smokers to respectively enjoy those taste and draw considerations they most favor in a cigarette while on the other hand enforcing and altering per cigarette utilization habits of smokers in a direction sharply reducing the health hazard inherent in ANY cigarette and in cigarette smoking generally, where cigarettes of the invented genre are used. Accordingly, basic service of the applicant's Burn Barrier is to establish, as opposed to conventional cigarettes, a more forwardly located point rearward of which the cigarette cannot readily be used for smoking purposes while yet retaining rearward of said point the customary tobacco content of such cigarette for purposes of flavor satisfaction, and the health objective of designing such a point into the manufactured cigarette is in line with our present scientific knowledge that deliverance to the smoker of harmful materials increases geometrically as the cigarette is consumed closer to its inhaling end. Thus it is well known that, if a smoker is to engage in the act of smoking for five minutes, it is less injurious to his long range health if he shall do this by smoking two cigarettes down each one inch from their originally lighted ends than if he shall do this by smoking a single cigarette down two inches from its originally lighted end, essential equality of cigarettes herein assumed. The invention assures, at the least, that a smoker shall devote each five minutes of his smoking time in the former manner, not in the latter, and in most instances it will likely go considerably further than this, reducing actually the total AMOUNT of smoking indulged, as some of the appeal of smoking is mechanical, is nervous release, is simply in the diversion of obtaining, holding and lighting up a cigarette, so that one who will smoke a cigarette down two inches or more from its originally lighted end can by no means be assumed invariably desirous or disposed, as substitute within the same time period, toward smoking two separate cigarettes down a restricted one inch from their originally lighted ends. Such a smoker may well simply opt for one cigarette still, and smoked less fully. The known factor of human inertia, the known tendency of a slightest interruption to have power for diverting and postponing an original intent both fully support the assertion just made.

Referring now again to those figures of the drawings in which either the concept or the actual implementation (thus far, for the latter, via only an applied finger edge slippage barrier) of a Preventive Section on cigarettes is illustrated. FIGS. 3, 4, 5, 6 and 7, it will be clear that this same Preventive Section is a desirable and serviceable area within which, for the sake of the smoker's health, the use of the cigarette for smoking purposes should be terminated and should, indeed, by manufactured design be AUTOMATICALLY terminated. Precise and specific location within this general longitudinal area would not be expected to be designated as a limiting factor of the invention, but would instead be a matter for optional adaptation of the invention by each or any manufacturer of cigarettes, unless and until government by legislation or regulation shall establish a minimumly rearward location point accompanying a mandate for inclusion of a burn barrier upon a cigarette. While FIG. 3 with its indicative arrows plainly demonstrates the applicant does not intend the invention be limited to inflexible locational boundaries, specific locational limits will, nonetheless, be urgently recommended by the applicant and for reasons to be disclosed, one such presently mentioned reason certainly being that a burn barrier placed at a point having little relation whatever to any reasonably inferred accomplishment of the applicant's object would not be construed as adoptive of the invention, the unclaimed and equivocal mention of a "snuffing feature" and, in relation to this invention's object of restraint against the smoking of a cigarette too far rearwardly, the consistently inappropriate location of the device of William's U.S. Pat. No. 2,192,569, Mar. 5, 1940 being one case in point. It will be understood that, inasmuch as a Burn Barrier located according to the invention, accomplished according to the invention, operative according to the invention and functionally intended according to the invention is not found within the present and prior art, then any such barrier will be incorporated within the claims of this invention without regard to variations of method equivalent in essential particulars of effect, and that therefore specific examples of means presented here are not intended as inclusive nor thereby limiting of the invention, which is limited only by the claims.

Referring now to FIG. 14 of the drawings there is depicted at 26 a Burn Barrier manufactured upon cigarette 84 according to the invention. This Burn Barrier consists of a longitudinal section of the perimeter of the cigarette which has been rendered "fireproof" in the sense that its minimum combustion point has been made well above the temperature range of burning tabacco or other substance comprising the cigarette generally. This particular type of Burn Barrier upon a cigarette can be accomplished in any number of ways through a coating treatment of the cigarette paper itself at the functioning area or through application of an immobile band of second layer enwrapment material to the area's surface, inside or out, and having the required fireproof character (immobility is an essence of the invention—the smoker is not to participate in the functioning of the invention or to readily control its point of activity). The essential requirements in both cases are that the perimetrical inner or outer surface be itself rendered non combustible at a cigarette's burning temperature and that it also be rendered sufficiently non porous as to effectively smother out the burning process of the cigarette's inner substance, and the further essential in the case of an applied coating treatment to the paper directly is that the applied substance be non contaminative, non-toxic of the paper and its tobacco content. The range of possibilities for the smothering mode of the substance selected would include but in the applicant's view is not preferably a substance with low melting point which would smother through liquid saturation.

Almost any thin metal foil neither toxic nor carcinogenic in ordinary contact would be suitable in the case of a band of second layer wrapping, aluminum being one the applicant has found effective of the purpose and safe as against toxic or unpleasant effect, the relative moderate heat of a cigarette's burning end combined with its short life within the barrierized area being insufficient to result in any fumes or oxidation of the metal or consequent taste alterations therefrom. A band of aluminum 5/16" wide and of ordinary household thickness will extinguish the cigarette completely if the smoker makes no extraordinary puffing effort to deliberately nurse the cigarette's glowing end through the barrier, an effort which, if undertaken, is accompanied by little or no smoking satisfaction during the period. But if the band is made as much as 7/16" wide, which is the applicant's best recommendation, in operation a smoker for all practical purposes simply will be unable to maintain any burn or smoking function of the cigarette through the burn barrierized area and the cigarette will be discarded immediately or shortly upon its consumption to the forwardmost point of the Burn Barrier. In the case of either suggested width band, or any intermediate width, a cigarette discarded without full extinction will not continue to burn for more than minimal (5 to 15) seconds once the barrier is reached, and any such burning will be internal, exposing no glowing surface to inflammable materials, thus also fulfilling another object of the invention, a cigarette less likely to initiate fires. Other materials of composition the applicant has used for making cigarettes with effective yet unobjectionable Burn Barriers of the presently disclosed mode are ordinary electrical tape, as a second layer enwrapment band, and also water glass (sodium silicate) as a coating application. In the latter case, taking a commercial solution with a Baume reading of 41 and diluting same with two parts of water to three parts of original solution results in an aquous compound permissive of easy application of a thin but solid solid coating at the desired location upon the cigarette. A coating so constituted has values over the undiluted solution as follows:—it does not materially stiffen the cigarette wrapping paper if application prior to rather than after cylindrical conformation of the cigarette is contemplated, it does not result in the crackling noise nor the visual foaming of the compound upon contact with the cigarette's burning end as is otherwise the case in the instance of an undiluted commercial sodium silicate of 41 Baume reading, yet it is adequately functional to the purpose when applied over the applicant's preferred area comprising a 7/16" section of the cigarette's longitudinal surface. Any application of a sodium silicate solution results in less heat conduction than either electrical tape or aluminum coating or foil, heat conduction increasing in the order stated but in no case being sufficient to cause ignition of ordinary easily combustible but non-explosive material such as fabric, tissue paper, wood shavings, dried leaves and the like. The applicant has also found use of either aluminum foil or electrical tape pretreated by a bath in the indicated sodium silicate solution advantageous, in the instance of both, due to a consequent reduction of heat conduction, and in the instance of aluminum particularly in that a much thinner foil is therebye selectible as functional Burn Barrier. In operation Burn Barriers comprised of any of these substances or combinations function essentially the same—the burning end of the cigarette being smothered to extinction through lack of oxygen supply. As to cosmetic appearance, the applicant has not concerned himself greatly with this, except to experiment sufficiently as to assure himself that it is within the obvious resource of cigarette manufacturers to render acceptable coloration or other cosmetic treatment to Burn Barriers. The smothering function of the basic material selected will not be effected by any otherwise satisfactory cosmetic treatment rendered thereupon.

Having now disclosed one form of Burn Barrier according to the invention, and prior to furnishing representative examples of other modes for accomplishing the Burn Barrier function specifically, it is serviceable at this point to cover in some detail and analysis the question of location of means insofar as it bears upon best engineering of either single or plural means of the invention. While the invention is not limited to precise locations, neither are the various means effectively located by any arbitrary and casual choice as might be governed by aesthetics or presumption. Particularly is the means for arrest of forward finger edge slippage a matter for careful locational engineering. We address the disclosure to that consideration now:

Empirical research and experiment will reveal that the range of finger hold area upon a cigarette as it is determined by the SMOKER, not by the manufacturer, does not remain the same as the manufactured length of the cigarette is altered. As proof, a cigarette smoker can easily demonstrate this for himself—

(a) Let the smoker light up an 84 millimeter filter cigarette and observe where he holds it in the beginning. Let him continue to observe the location of his finger edges as he continues to smoke the cigarette, whether or not he lays the cigarette down several times in the process—it makes no difference. The smoker will find that he early and continually adjusts his finger hold according to the changing length of the cigarette. Nor is this entirely a matter of adjustment to the proximity of the approaching burning end. It is rather a more subtle sense of balance, as will be apparent when (b) the same smoker shall light up successively two cigarettes of different lengths. Let one be the same 84 millimeter cigarette and let the other be a 99 millimeter cigarette. The smoker will ordinarily find, if he can nullify the effects of his own consciousness of the experiment, that invariably he will begin by grasping the longer cigarette further away from its inhaling end than he grasps the shorter cigarette. If divorcing himself from foreknowledge of the presumed outcome of the experiment is difficult, as it well may be, he can conduct the experiment on others not advised of its purpose or expected result.

What the reader will doubtless approximately conclude from even minimal observational experiment as suggested above, the applicant has confirmed through quite extensive observation and study among rather considerable numbers of smokers, such that the applicant presents as ideal for an 84 millimeter cigarette, and very near minimal, that those means of the invention concerned with Preventive Section arrest of forward finger edge slippage shall have rearward terminus or termini upon the cigarette not less than 1¾ inches forward of the cigarette's inhaling end, but he specifically cautions that to presume a similarly located rearward terminus or termini would be satisfactory (functional) for a 99 millimeter cigarette would constitute critical error, again—as concerns those means functionally involved with forwardly located arrest of forward finger edge slippage. Rather, in the case of a 99 millimeter cigarette the rearward terminus or termini of such means should be advanced by not much less than half of the additional cigarette length, by at least 7 millimeters—ie—on a 99 millimeter cigarette the rearward terminus of Preventive Section anti slippage means should not be closer than 2 inches distance from the cigarette's inhaling end. Where these recommendations are relaxed the invention's effectiveness in arresting forward finger edge slippage will be reduced in a quantitative way—that is, in increasing numbers of smokers the slippage barrier will be found uncertainly located for consistently serving its object. From the standpoint purely of the invention's mechanics, really close locational limits are critical only as pertains or effects the slippage barrier means, not the Burn Barrier. If recommendations the applicant shall make for location of Burn Barrier means shall in fact be altered in practice, then the invention is merely adapted in an electable, subjective way, but it is not therebye poorly engineered. It will as a matter of fact later be seen that the selectability of operative locations for the Burn Barrier means according to the extent of restraint desired in a perticular object is indeed one distinguishing, novel and highly utilitarian feature of the inventive concept. Where location of the Burn Barrier IS critical to the total invention, however, it will later be seen, is where it could physically negate the efficiency of the slippage barrier. In such a case the location of Burn Barrier must give way, or the problem must be otherwise resolved, as it can be, through available elections of manufacture.

It will be apparent, or made apparent, that an arresting barrier against forward finger edge slippage and a health and safety barrier (Burn Barrier) against prolonged combustive life of a cigarette coincide in a newly purposed section of cigarette's not extant in the present and prior art, in most instances a slightly forward of center device the applicant has termed the Preventive Section. While such a device could and possibly will be manufactured into cigarettes with fewer than all of the stated objects operative (by ommission of means) and, thus, means to separate objects are claimed separately in the claims, nevertheless the applicant conceives his invention is properly personified in total as a multi-purposed, multi-functioning single apparatus of manufacture, novel not only in each of its parts and objects but likewise in its combined parts and objects, such combination being not in the nature of aggregation or the mere combining of previously known means and objects, but being rather the combining of new and plural means and objects into new reciprocal inter-action attaining a common object, such that the applicant makes generic claim for his Barrierized Cigarette and for his Preventive Section of a cigarette. The reciprocal inter-action of combined means is made apparent later in this disclosure.

It will be readily seen the invention is sociologically, ecologically and conservationally based and directed. It is not particularly adapted to impulse demand by the consumer nor to enthusiastic initial acceptance by smokers generally, speaking, in the latter regard, with particular reference to the burn barrier function. Thus, while the applicant conceives that, from the standpoint of attainable sociological benefit, the forwardmost termini of burn barriers can ultimately and ideally be seen 1 3/16" back from the lighting end of an 84 millimeter cigarette and 1⅜" back from the lighting end of a 99 millimeter cigarette, he also recognizes that neither the private cigarette industry nor government, the one through voluntary product control—the other through regulation, legislation, tax or advertising encouragements, is necessarily prepared to commence with ultimate standards and ultimate safety-health provisions for the public good, the sociological balance in our form of society being usually a compromise struck somewhere between permisiveness of possibly harmful indulgences which individuals see as their private right and proscription against some antisocial practices, substances, manufactures or exposures which informed government through advancing science perceives as intrinsically harful to society. Accordingly, while the ideal and ultimate (in the applicant's private view) Barrierized Cigarette is typified in FIG. 15, an example of an alternate, possibly preliminary version effecting less extensive health benefits but imposing, also, less radical and immediate alteration upon the public's present smoking habits and preferences, is appositionally depicted in FIG. 16. In FIG. 15 at 85 is shown an 84 millimeter cigarette generally with a Preventive Section 27 of length 7/16" in which section the barrierization against forward finger edge slippage and the barrierization against combustion are accomplished concomitantly within the same 7/16" confines, the forwardmost terminus of which Preventive Section is located 1 3/16" back from the lighting end of the cigarette and the rearwardmost terminus of which is located 1¾" forward of the inhaling end of the cigarette, and at 86 is shown a 99 millimeter cigarette generally with a Preventive Section 28 identical to that of cigarette 85 with the exception that the forwardmost terminus of Preventive Section is located 1⅜" back from the lighting end of the cigarette and the rearwardmost terminus is located 2⅛" forward of the cigarette's inhaling end. Now these two cigarettes in drawing 15 show the applicant's already stated ideal and ultimate utilization of his Barrierized Cigarette concept as it could benefit the health of smokers and these two cigarettes could and do combine the finger slippage barrierization and the Burn Barrier means within the same locational limits of the cigarette and without sacrificing ideal placement of the slippage barrierization. In the case of these particular two cigarettes the Preventive Section comprises simply a band of aluminum foil the outer surface of which has been given roughage through a suitable spray paint application having moderate texture and which serves a cosmetic coloration function as well. It is to be remembered that type and degree of frictionalization need be, respectively, neither as restricted nor as pronounced in the Preventive Section as it would have to be in the finger hold section.

From the standpoint of public health these two cigarettes would accomplish (using here, for purposes of conservatism as well as purposes of abridgement, data applying only to the 84 millimeter length) a reduction of inhalations per cigarette smoked ranging from zero reduction in extremely rare instances to 8 inhalations (or 54%) reduction in, again, relatively infrequent instances, with the very heavy concentration of number of inhalation reductions falling in the 5 to 6 inhalations (or about 46%) reduction range. The over all effect on the health of smokers is, of course, not available in ratios as simplistic as the foregoing, but can be estimated only through the additional consideration of other factors such as, in all instances the greater toxicity of those inhalations eliminated as compared to those retained, in some instances the tendency of smokers to "catch up" —to increase the number of cigarettes consumed daily, and in many contrary instances, particularly foreseeable as a long range effect, the tendency of smokers to even reduce the number of cigarettes consumed daily, due to gradual reduction in physiological dependence upon cigarette smoking as such dependence is related to chemical levels to which the body (system) has become habituated. One thing, however, is readily understood according to our present knowledge and without need of extensive analysis—those whose health is now most threatened would be the ones most benefited. The invention is adapted automatically to a singularly provident feature:—the greater the need, the greater the service. But initial location of Burn Barriers as far forward as depicted in FIG. 15 would, without question, induce considerable discontent among the smoking public today by reason that it would quite noticeably alter and constrict the present smoking habits of most of that public as regards utilization of each individual cigarette smoked.

Therefore in appositional FIG. 16 at 87 is shown an 84 millimeter cigarette generally with a Burn Barrier 29 of 7/16" length, the forward and rearward termini of which are located, respectively, 1 10/16" rearward the lighting end of the cigarette and 1 5/16" forward the inhaling end of the cigarette, and at 88 is shown a 99 millimeter cigarette generally with a Burn Barrier 30 identical to that of cigarette 87 with the exception that its forward and rearward termini are located, respectively, 1 13/16" back from the lighting end of the cigarette and 1 11/16" forward the cigarette's inhaling end. Now the desired and indicated locations of the Burn Barriers in each of these two cigarettes do not coincide in their rearward termini with a satisfactory location for rearward terminus of a finger edge slippage barrier within the Preventive Section of a cigarette, such Burn Barrier rearward terminus in each case commencing in fact too far rearward in relation to the overall length of the cigarette and the influence of said length upon the smoker's selection of an area for initially grasping the cigarette between his finger edges (it is not to be assumed that the smoker will ADAPT his location of early grasp according to the confines of a Burn Barrier, taking care to apply his grasp rearward of it—he will not do this—he will grasp the cigarette where he wishes to according to his sense of balance, as a Burn Barrier will not with commercial objectives be rendered in such obtrusive form as to significantly discomfort a smoker's finger edges). Thus in the case of these two cigarettes of FIG. 16 the Burn Barriers in each instance are applied upon or against the INNER surface of the cigarette wrapping paper and whatever device against finger edge slippage is elected is manufactured independently upon the OUTER surface of the wrapping paper and commencing only at a rearwardmost point suitable for Preventive Section finger edge slippage deterrence, in the case of cigarette 87, a blister barrier as indicated at 31 with a rearwardmost terminus 32 not less than 1¾" forward from the cigarette's inhaling end, and in the case of longer cigarette 88 a surface of sandpaper like clusters as seen at 33 with a rearwardmost terminus 34, here 2⅛" but in any case not less than 2" forward of the cigarette's inhaling end. The Burn Barrier in these two cigarettes comprises a coating of sodium silicate as described previously and, in these cases, upon the inner surface of the wrapping paper in the functional area. These two cigarettes as examples of contemplated but not limiting variation of the invention will be seen to accommodate those manufactures where all functions of the invention are intended but where their precise locations of operation are not desired to be identical.

In the particular instance of cigarettes 87 and 88, where Burn Barrier means is elected to be placed within the finger hold section of a cigarette, choice of sodium silicate for Burn Barrier would not be well made for application upon the outer surface of the cigarette. Sodium silicate renders a glassine surface to the side of the paper so coated and, while the forward finger edge slippage barrier would serve its object notwithstanding, it does not seem best engineering to unnecessarily slicken the finger hold section of a cigarette. Thus the applicant has illustrated here that from the many options available to a manufacturer in rendering a Preventive Section engineering care should be taken that a Burn Barrier does not defeat, reduce or unduly burden the efficiency of a slippage barrier.

It will be apparent the primarily intended distinction between the cigarettes of drawing 15 and the cigarettes of drawing 16 is to enable, in the case of the cigarettes of FIG. 16, an application of the Burn Barrier concept which, while yet producing a cigarette less hazardous to the health of smokers and to the safety of persons and property generally, is nevertheless less restrictive and therefore less disruptive the presently ingrained habits of smokers in total. It is also evident, therefore, that by applied location the invention can be rendered in any intermediate fashion, accomplishing any balance between general acceptance and sociological good that may be determined as suitable objective. As to the effect upon the health hazard of cigarette smoking as it would obtain in the case of cigarettes 87 and 88 of FIG. 16, the applicant states the effect would be appreciably reduced in relation to the effect available through more forwardly located applications of a Burn Barrier upon a cigarette, but yet very significant in relation to cigarettes presently smoked. These two cigarettes of FIG. 16 (again for conservatism using the 84 millimeter cigarette for standard) would accomplish a reduction of inhalations per cigarette smoked varying from zero reduction in a reasonably small portion of instances to 5 inhalations (or 33⅓%) reduction in relative infrequent instances, with the very heavy concentration of number of inhalations reduction falling in the 2 to 3 inhalations (or about 23%) reduction range. The increment of health benefit due to the added fact of inhalations eliminated being more toxic than inhalations retained would be less than in the case of more forwardly located Burn Barriers, but the increment would still be substantial. Initial discontent with the innovation among the smoking public would be considerably reduced for the reason that encroachment upon present smoking habits would cut not nearly so deep and would be more than proportionally less noticed.

The applicant forsees the presence of a Burn Barrier in a Preventive Section of a cigarette as a reasonable and perhaps ultimate answer to the general problem of cigarette smoking and health, a redeeming adaptation the industry may eventually need for survival in the evolving framework of scientific discovery and social concern with matters of health. On a smaller scale and perhaps more imminent, the applicant points up the obvious potential for use of such cigarettes in cancer, heart, respitory and related research, whether by government agencies or by private agencies. The feasibility of manufacturing such cigarettes with graduated locations of Burn Barriers opens up broad possibilities for more precise experimentation and research and for the accumulation of extremely conclusive data. It is also properly noted at this time that the applicant has several times assumed a resistance to and discontent with Burn Barriers on cigarettes as anticipatory among the smoking public generally, initially at least. This is felt to be a realistic assumption where and if such means become mandated and it applies only to Burn Barriers, not to Preventive means against forward finger edge slippage, as the latter need impose no change or departure whatever from the smoking public's present habits and preferences. As to the applicant's Burn Barrier it is obvious he views it in a sociological framework, but this does not mean the invention is, or that the applicant believes it to be, without commercial promise in the competitive market. Millions of cigarette smokers who have not altered their smoking habits are nonetheless uneasy regarding the possible effect of the habit upon their health. There is doubtless a substantial market among these smokers for a cigarette which will give them everything they like and are accustomed to as to taste but which will enable their use of each individual cigarette in saner direction as regard their health. (Estimates given regarding "reduction of inhalations per cigarette smoked" are based on observational and experimental work done by the applicant in contact with appreciable numbers of smokers. They are weighted conservatively insofar as regards the applicant's findings, but the work has not been done in quantity or under laboratory controls such as to merit scientific status.)

Other examples of Burn Barrier means according to the invention are now presented, one such seen in FIG. 17 where cigarette 89 is shown with linearly defined and connected areas 35 wherein the cigarette's wrapping paper has been chemically treated with suitable substance rendering the paper subject to accelerated combustion specifically and limitedly along the lineal definitions thereof. (Some readers will recognize and remember similarly treated thin paper from years back, as an entertainment novelty simulating horse or automobile races, etc.). It is also probably within the experienced knowledge of most readers of this disclosure who are also smokers that a hole or a slit or other break in the enwrapment paper of a cigarette will effect adversely the efficiency of the cigarette for smoking purposes, from the standpoints of both draw and combustion. The operation of this version of Burn Barrier relates to the foregoing fact. When the burning end of the cigarette reaches the forwardmost point of barrier treatment the treated line of paper burns rapidly back to its rearward terminus and to all its termini, leaving the cigarette malformed for smoking purposes. While sustained, continued puffing could possibly prolong combustive life of the cigarette, little smoking satisfaction is attainable and effort to smoke the cigarette can in most instances be expected to be abandoned early within the barrierized area. In regard the object restraint against smoking a cigarette too far rearwardly in the better interests of health a well rendered Burn Barrier of this construction will be substantially effective. There are doubtless innumerable compounds which would be satisfactory for the linear treatment described. One the applicant has found functional is the fullest possible saturation of distilled water with potassium nitrate. Here (with potassium nitrate solution) the linear treatment must be accomplished on the cigarette paper before cigarette conformation as both sides of the paper should be given the linear coating. Referring again to FIG. 17, cigarette 90 at 36 is shown with a conformation of linear pattern for accelerated combustion the design of which is suggested as superior to the pattern at 35 inasmuch as the more tortorous linear course of the treated area will better hold the cigarette and its tobacco content together after the accelerated burning while yet affecting the same unsuitability of the cigarette for further smoking. Variances of pattern or of accelerating substance used, however, are not intended as features of or limiting of the invention, which is limited only by the claims. As a matter of information it is pointed out that the accelerated burning of the treated area in the present version of Burn Barrier will not cause discomfort or injury to the holding finger edges, and for two reasons: Firstly, the finger edges, when the burning end of the cigarette attains the Burn Barrier's forwardmost point, are no longer located as far forward as the Burn Barrier's rearwardmost point, having by then shifted rearward thereof; secondly, the rapid burning of the treated area is fed by a thin linear supply of the combustible substance, rendering the heat generated quite minimal, momentary and insufficient to radiate beyond the actual area of conflagration. It will be noted that both cigarettes 89 and 90 have finger edge slippage barriers, respectively shown at 37 and 38, in the first instance the now familiar ring of radially extending blisters and in the second instance a series of circumferentially striped areas where the cigarette's surface has been mildly tackified. If a blister barrier is used for slippage deterrence, FIG. 18 depicts a mode of adapting the blisters themselves directly to the Burn Barrier function. A selected few of the blisters (shown by shading) 39 are given accelerated combustion quality and connected to similarly treated arterial "tracers", 40, leading forwardly to and establishing the Burn Barrier's forward termini. When the cigarette's burning end attains these treated arterial terminals the accelerated burn is quickly conducted to the treated blisters and the cigarette is quickly malformed for smoking purposes.

Significant reference is here made to the fact that the three cigarettes of FIGS. 17 and 18 depict Burn Barriers located on the cigarettes either concomitant with or extending forward of those means also provided against forward finger edge slippage and, in any event, having functional termini well forward the rearwardmost termini of means against forward finger edge slippage. It will be remembered the applicant's inventive concept for a Barrierized Cigarette and for a Preventive Section thereof included the concept of reciprocal action among plural means to the fulfillment of a common object and it will be recognized through previous disclosure herein that a slippage barrier located forwardly of those areas usually employed for gripping a cigarette constitutes the applicant's preferred safeguard against the dangerous phenomenon forward finger edge slippage along a cigarette and to its burning end. Yet the placement of such a barrier is necessarily at a point well forward of any location where many smokers discontinue smoking a cigarette, such that, in the case of these same many smokers, a forwardly located Preventive Section comprising slippage barrier alone—would constitute a cigarette protecting such smokers only during that period prior to the fact of the cigarette's burning end attaining and consuming the barrier itself. Once the barrier is consumed in the process of smoking the smoker no longer has protection against the hazard of forward finger edge slippage. The applicant's Burn Barrier therefore can be recognized as a timer enabling total provision for one object of the applicant's Preventive Section—optimum prevention of forward finger edge slippage to the burning end of a cigarette. Properly placed in reciprocal relation and function as, for several examples; in the cigarettes of FIGS. 17 and 18 and also in the cigarettes of FIG. 15 where there is concomitance of location, the Burn Barrier extinguishes the cigarette, or otherwise discourages its continued use as smoking article, just prior to that point where the slippage barrier would otherwise cease to function. It is apparent that, alone, a Burn Barrier has little relation to an object of preventing hazardous forward finger edge slippage. It is equally apparent that, without the Burn Barrier, the Preventive Section slippage barrier is functional for only a portion of that time the cigarette's burning end may continue to lend danger and consequence to the phenomenon forward finger edge slippage. It is easily seen that the two together, slippage barrier and Burn Barrier, in interelation afford a total protection against the hazard of forward finger edge slippage which is unavailable through employment or use of either of them singly. That a Burn Barrier placed at any point rearward of which there remains a smokable or cumbustible substance within the cigarette will have other interpretable functions and objects than exclusively that of reinforcing a slippage barrier will be recognized of course, and a manufacturer's selection of location for a Burn Barrier in relation to (or even in the absence of ) his location of slippage barrier means will be seen indicative of his own particular stress and weighting of the several functions and objects of a Preventive Section, but the fact that a Preventive Section is manufacturable with varying emphasis on multiple objects or, indeed, to the exclusion of one or more objects, will not negate the reciprocal character of those means in that manufacture which does combine said means in such a way as clearly gives them reciprocal relationship in respect a single object.

As alternative to a combustion process for malforming the cigarette for smoking purposes and within the applicant's Burn Barrier concept, a cigarette can be manufactured such that an arterial or other transfer of heat will accomplish the malformation through a melting process. Referring to FIG. 19, enlarged depiction at 41 shows a section of cigarette paper generally (prior to cigarette conformation) with the perpendicular representing the direction of eventual cigarette encirclement. This paper is of such manufacture or process as has first been cut away in the eventual functional area with an aperature of narrow ovular shape, perhaps ¼" long and ⅛" wide at its broadest point. Such original aperature is perimetrically defined at 42 of the drawing. Then the aperature or breach has been repaired under conditions of closure tension and with an adhesive sealant of relatively low melting point, the sealant thus comprising the closed, airtight but stressed surface area circumferentially defined by 43 in the drawing. The paper has also then been treated with, or had laminated thereupon, an arterial tracer of high heat conductivity, such as aluminum, running from the center of the repaired aperature forwardly out toward the eventual lighting end of the cigarette and establishing the Burn Barrier's forward terminus. This tracer is whown at 44 in the drawing. On cigarette 91 generally the just described manufacture is shown as device characterizing a completed cigarette where 45 is the ruptured but repaired surface of the enwrapment paper and where 46 is the forwardly extended, high heat conducting artery leading into said rupture. In operation, when the cigarette's burning end attains terminus P heat is increasingly delivered through artery 46 and to low melting rupture center 45 which, upon melting, due to tension set in the closure process, will split apart, rendering the cigarette sufficiently malformed as to be unsmokable according to the demands of normal smokers. One type of sealant satisfactory for this implementation, the applicant has found, is ordinary household paraffin or candle wax. Neither of these will melt at ordinary weather induced temperatures but either one will melt from the conducted heat of a burning cigarette. In manufacture, this mode of implementing the invention requires careful engineering and standardization. The meltable sealant selected, the heat conducting capacities of the tracer material and the location of forward terminus of the tracer should be coordinated and standardized in a manufacture such as will result in operativeness the Burn Barrier in essentially the same location in each cigarette produced. There will always be variable and determining factor not subject to control by manufacture—the puffing habits, timing and power of draw of each individual smoker and for each cigarette smoked, but these will cause only minimal variation which will not negative functional operation the Burn Barrier in relation its object. Smokers who, in smoking, draw the more frequently or the more deeply will tend to malform the cigarette just slightly earlier (from the standpoint receding length of the cigarette) than smokers of opposite smoking traits, but it is also these former identified smokers who may stand most in need of a moderated usage of each individual cigarette smoked.

Another version of Burn Barrier according to the invention and incorporating in a different way the just described (FIG. 19) principle of a vulmerably repaired manufactured breach in the cigarette's enwrapment paper is shown in FIG. 20. Cigarette 92 depicts an incompleted cigarette of this manufacture, the cigarette's ordinary enwrapment material having been perforated or otherwise punctured with a hole or holes as shown at 47. The cigarette in this condition is basically unsmokable, as any reader experimentally inclined can confirm for himself. At 93 is shown the same cigarette after its final step of manufacture, which step consists of locating the breached area intermediate the termini of an elastic or otherwise resilient sheath affixed thereover and upon the cigarette under condition of longitudinal tension, anticoil or both, the sheath being secured to the cigarette, both as to location and as to conservation of tension or anti-coil, by gluing or other fastening essentially limited to a circumferential end portion of the two longitudinal termini of said sheath. "Essentially limited" herein describes the fact that requisite means for maintaining the stretched or anti-coiled state of said elastic or resilient sheath is dominantly and finally afforded by the strength of the anchorage of its two terminal ends. If necessary, and to relieve the stress upon the cigarette's length over-all, intermediate portions of the sheath may also be, and relatively weakly, adhered to the cigarette's surface, but if this resort is adopted the essential factors are that such additional areas of adhesion are singly and cumulatively insufficient of themselves to withstand at any stage the total bias toward recoil of the strethed sheath and that they are likewise singly and cumulatively inferior in adhesive strength to the single adhesive strength of the rearward terminus of the sheath. Preferably the elastic or resilient sheath is of material preset with a strong and lasting bias toward recoil by outward curling in relation to the circumferential plane of the cigarette, because this direction of stress is more compatible with the physical limitations of a cigarette for withstanding same than is a stress of totally straight elasticity. The longitudinal seam of the sheath itself, effecting and maintaining its closed cylindrical form, should be an overlap of the two opposite longitudinal edges of the material of composition, not an abutment thereof, so that the source of continuous longitudinal cohesion of the sheath is a condition of adhesion of said overlapping edges to each other, not a condition of any longitudinal adhesion to the cigarette itself. At both termini, of course, circumferential adhesion of the sheath to the cigarette paper must be complete and continuous so that the entire chamber created by the sheath is air tight. In operation the completed cigarette is fully smokable, having no essential loss of efficiency, taste or draw until its burning end attains the forwardmost terminus of this sheath or Burn Barrier, at which point anchorage supplied at the forward terminus is removed by combustion or melting, removal of said anchorage resulting in recoil of the tensed elastic or otherwise resilient sheath to a removed point rearward of the breach or breaches in the cigarette's main enwrapment material, the now exposed situation of said breach or breaches malforming the cigarette for acceptable smoking purposes.

To avoid possible misengineering of the device important items of location are here noted:—In the cigarette of illustration, 93, the perforations or holes are acceptably located where shown at T. In the particular cigarette of illustration, however, the perforations could as well be located in any longitudinal section of the cigarette between points p and e, but they should be confined within such indicated area and for these reasons:—To locate the perforations forward of point e would tend too nearly to approach the location of the cigarette's burning end at the time the barrier device shall become active since, if the active combustion of the cigarette shall touch or cover the perforations then the perforations are of no effect upon the drawing qualities of the cigarette and the inventive device is defeated. To locate the perforations any significant distance rearward of point p, on the other hand, can tend to reduce the efficiency of the Burn Barrier device in another way—that is, at the time the device becomes active at point w, the holding finger edges might conceivably be positioned nearly astride the perforations and therebye prevent the recoiling sheath from adequately clearing and exposing said perforations. No smoker will comfortably and by choice grasp a cigarette nearer than ⅝" distance from its burning end where he has the option not to do so, but distances greater than this fall increasingly within the holding location habits of smokers generally. For proper functioning of the device, therefore, it will be seen that area pe and forward terminus point w will stay relatively stably spaced in relation to each other as the device generally is shifted forward or rearward in accordance with a manufacturers election for operative location of the device. Point r, rearward terminus of the sheath as depicted in the cigarette of illustration is, however, relatively open to relocation, the applicant having in this instance shown the point as reaching into the filter enwrapment area of the cigarette in order to demonstrate the option of selecting the firmer anchorage thereof for rearward terminus. Such selection for firmer anchorage may not in all instances be requisite, however, and point r may in fact by any point suitably rearward of the perforations, a minimum distance therefrom of ¼" being nevertheless still recommended.

It is pointed out that perforations 47 and T depicted in FIG. 20 are indeed perforations, they are not blistered antifinger edge slippage means. This general form of Burn Barrier while, if elected, it could in some instances complicate the engineering of a proper finger edge slippage barrier, it is in no way preclusive of same. Forwardly located frictionalization or any located functional frictionalization can now be accomplished by trade artisans upon the sheath itself, given access to all the previous disclosure herein.

It will be understood that an elastic or otherwise resilient repair sheath or chamber as described with reference to FIG. 20 may derive its "resilience"

through means other than inherent-characteristic of the physical material of composition and that it is likewise not the applicant's intention, either, through descriptive words such as "sheath" to limit the invention either to materials of composition or to semantics of shape or form. Thus, in the cigarette of FIG. 20 the perforations or punctures circumscribe the cigarette entirely (which they need not necessarily do) and, therefore, that remedy which may best compensate for these particular punctures in a cigarette's enwrapment surface, effectively sealing off each and every one of them from air, may well be envisioned as and conveniently termed a "sheath". To seal off each individual puncture with its own individual elastic second layer covering, however, each of which would perhaps then be called "strips", creating airtight "chambers" therebye, is electable engineering option envisioned by the applicant, as so are ample other elections suitably and equivalently implementing the inventions core concept here—the manufacture of a cigarette with basic deformity hostile to the act of smoking, said deformity repaired with a device itself inherently, by design and with object, limited as regard its effective and functioning duration upon a cigarette being smoked. The cigarette of reference in FIG. 20 depicts a sheath of stretched rubber or latex. Thus eventual and intended recoil of the device to a position rearward of punctures T derives critically from the material or substance of which the sheath is constituted. On the other hand, and illustrative the scope of the invention, FIG. 21 at 49 depicts a "sheath" in general, manufactured upon a cigarette, covering basic deformity not illustrated but similar to 47 of FIG. 20, and manufactured for eventual and intended uncoiling, said uncoiling provided for not critically through peculiarities of materials of composition but, rather, critically through applied mechanics, through means of leverage. Sheath 49 is formed of a ½" wide strip of ordinary cigarette wrapping paper. It may or may not have been given preturnatural resilience through a chemical treatment, the factor being without critical consequence. Critical assurance of resilience is provided in the fact the strip has been wound around the cigarette diagonally forward from a rearward terminus L adhered to the cigarette and to a forward terminus G, also adhered to the cigarette, such diagonal winding therebye covering the desired longitudinal section of the cigarette in tensed spiralling fashion and such that the rearward longitudinal edge of the strip is continually overlapping the forward edge from previous convolution. The device completed forms a "sheath" surrounding the impaired portion of the cigarette and the sheath is sufficiently "airtight" as to functionally permit unimpaired smoking of the cigarette while at the same time being fastened to the cigarette and itself essentially held together by anchorage only at its forward and rearward termini. Further, and in operation, the spiralling configuration of ordinary non rigid material of composition affords a bias toward uncoiling once either terminal anchorage is destroyed, in the case of destruction or removal of forward terminal anchorage the direction and fact of uncoiling affords not merely a loosening of enwrapment but actual destruction of the sheath-like conformation and continuity of the enwrapment, such that the malformed nature of the cigarette for smoking purposes is no longer compensated or remedied when its burning end attains and consumes the forward terminus and anchorage of the device. At 50 generally is seen the strip of cigarette paper before application to the cigarette. Point Q is the eventual forwardmost terminus of the device, line XY is the attitude of the cigarette in relation to the strip of paper before the spiralling enwrapment is begun, Y being the inhaling end of the cigarette and X being the lighting end, and arrow Z indicates the plane of enwrapment motion as it will be defined by movement of the enwrapping material. The shaded areas at Q and L are the only locations where gluing need or should be employed. Line QK is the curved line where a portion of the rectangular strip of paper has been cut away to eliminate unneeded section S. Removal of section S before winding the strip onto the cigarette and forming the sheath results in a sheath with no extension to brush against the cigarette's burning end in the process of uncoiling. If desired a small portion of the device depicted by lateral lines V could be made non combustible through treatment, such as with a sodium silicate solution. FIG. 21 will be understood illustrative of yet another approach to implementation of the invention but not as substance or essence of the invention itself.

Burn Barriers having the object of regulating the smoker's use of a cigarette toward a consumption less hazardous to his health have thus far in the disclosure been confined to means involving essentially the inner or outer perimetrical surface of a cigarette. However, the applicant does not intend the means of his invention to be so restricted and satisfactory means for regulating the smokable life of a cigarette characterized by more internal device are incorporated into the invention. excluded only are any such devices, internal or external, as may seek to render the product of combustion distasteful in a segment of a cigarette or any device which unavoidably and distinctly must have such result, such as the employment of a forwardly located filter which, having possibly the incidental feature of relative non combustibility, imposes additionally the objectionable feature of obnoxious taste and oder when directly attacked by a cigarette's burning end. It is not, nonetheless, the filtering function per se which would be totally incompatible with the applicant's concept of Burn Barrier, but rather the unsuitability of present filtering materials through the objectionable feature just mentioned. Within the applicant's intended means for Burn Barrier according to the invention, then, is any internal manufacture of a cigarette, whether or not affording incidental filtering effect, which accomplishes the prime object—Burn Barrier—without the objectionable features obnoxious taste or oder, two examples of such manufacture being herein disclosed as follows:

FIG. 22 depicts a cigarette generally at 94, which cigarette has an internal Burn Barrier according to the invention as seen at 51. At 51 there has been intermixed with the regular tobacco packing a quantity of tiny water capsules, 52. These capsules consist of water sealed within small cellulose or gelatine pellets, the epidermi of which remain solid and water retentive at ordinary warm temperatures but dissolve or melt at some selected higher temperature such as would be offered by direct contact with a cigarette's burning end or by the increasing proximity of said burning end. At its center the burning end of a cigarette can build to temperatures in the range of 400 to 500 degrees Fahrenheit, but peripherally and just adjacent the temperatures are considerably lower. For the pellets, it is suggested the melting temperature be selected somewhere in the range 160 to 250 degrees Fahrenheit and of course the exact dissolving temperature designed into the epidermi of the pellets would determine the physical location of the barrier in relation to the desired malformation point of the cigarette. In general it is best to engineer the barrier such that heat required for its operation is equivalent to peripheral contact with the cigarette's burning end or at least immediate adjacency thereto, as an immediate disabling of the cigarette through extinction of its burning is much preferable, from taste and other considerations, than a more gradual disabling through crippling of its "draw" qualities. In the cigarette of illustration, the water pellets 52 dissolve at a temperature of 180 degrees Fahrenheit or, thus, upon first contact with the burning end of a cigarette not in process of being puffed upon or slightly before such contact in the case of a cigarette being puffed upon. In the functional area 51 shown, the pellets occupy approximately 65% of the internal space of the cigarette as opposed to 35% tobacco occupancy thereof. This ratio does not impair the ordinary draw of the cigarette and it also allows for protection of the pellets by tobacco cushioning against the ordinary handling of the cigarette, yet it provides sufficient water to extinguish the cigarette when the burning end attains the point of barrierization, and this latter statement is descriptive of the device in operation—combustion heat dissolves or melts pellets, water is released and saturates otherwise combustible inner substance of the cigarette, combustion is eliminated and the cigarette is no longer a smokable article.

It will be understood the foregoing example of the invention wherein the cigarette is extinguished or impaired through a released liquid immersion of its combustible content is not intended to limit the invention to the exact materials and methods described, but is rather a single example of numerous equivalents, one such being, for instance, the functional equivalence of a solid or granulated substance of high water content as substitute for pellets containing water in uncompounded form. The applicant has had complete success in this regard with, again, the previously discussed 41 Baume sodium silicate diluted with water ratio of 2 for 3. This dilution in its dried, hardened state can be made into chips or granules with which the tobacco is intermixed at 51 of FIG. 22 in place of water capsules or pellets. In operation the result is substantially the same. There is no adverse effect upon the normal draw and taste of the cigarette, yet at the barrier point the cigarette is totally and quickly extinguished, and this, too, is accomplished without disagreeable effects. Other compositional matter with which the applicant has manufactured cigarettes according to the invention and having totally effective Burn Barriers of internal character are grains of rice, granules of laundry starch, granulated gelatine, granules of ice cream salt, small flakes or chips of dry yeast, and single, small kernels of (unpopped) pop corn. While some of these substances undoubtedly release an amount of water in result their contact with the burning end of the cigarette, which release doubtless has some part in the extinction of the cigarette, mainly it appears to be their swelling, expanding reaction to heat, possibly including gaseous releases, combined with their own relative non combustibility which quickly smothers out the cigarette's burning end, both through constriction of oxygen supply and through blocking of access to the combustible tobacco rearward the barrier. For each of these substances, the applicant has found, there is a preferred percentage of intermix of tobacco and preventive substance such as will fully accomplish the object of the invention while yet imposing alteration, if any at all, barely noticeable as regard the draw and other smoking considerations of the cigarette generally nor, at the time the cigarette is extinguished, is there any taste or oder not typical of a conventional cigarette which has lost its combustion. The best percentage of intermix usually approximates 65% constituency the introduced substance. The longitudinal cigarette area involved is small, averagely typified, again, by 51 of FIG. 22, ranging perhaps 1/16 to a scant 5/16 (small selected pop corn kernel), inch. The applicant believes further that yeast may have valuable qualities for the entrapment of tar and nicotine and is experimenting with its possible adaptation as filtering means for cigarettes.

In all the drawings and reference to them the applicant has chosen to disclose the invention in terms of the popular 84 millimeter and 99 millimeter cigarettes. It will be apparent all forms of the invention are adaptable to all commercial lengths of cigarettes, notwithstanding the applicant's private belief the shorter lengths will increasingly become a vanished genre importantly, as a matter of fact and in the applicant's view, because they do not best lend themselves to this or other endeavors aimed at reducing the sociological ills of cigarette smoking. However, in reference to the particular hazard of forward finger edge slippage it must be pointed out that the old 70 millimeter cigarette length never was as vulnerable to that phenomenon as are the present longer lengths. Occuring as it does through some lapse on the part of the smoker, forward finger edge slippage will be found to occur more usually during the pendency of a cigarette's longer length, and this is because, during the act of smoking, the further removed from his face is the glowing end of a cigarette the less attentive and deliberate will be a smoker's manner of handling and regarding same. It is believed a reader will intuitively understand and acknowledge this fact, but any in depth consideration of both psychology and the sensory functions will substantiate it. The principle is worth noting and considering, both by government and by private industry when considering what extent of provision against the phenomenon should be required or elected. Like all miscue, injury and death through the indirect causation of forward finger edge slippage will ultimately and isolatedly occur under ANY condition or provision but what shall substantially reduce the incidence as to render it acceptably contained by a reasonably prudent society? Will the deterrence of a forwardly located finger slippage barrier (which will unquestionably eliminate the phenomenon in all but a fractional proportion of its present occurrence) suffice, or is it necessary, further, that this deterrence be reinforced with reciprocal Burn Barrier or, otherwise, with supplementary means within the lip and finger hold sections? Any degree of containment short of absolute is believed available in this disclosure.

Review or recall of all the foregoing disclosure and specification will determine the applicant has, in the drawings and the descriptions, presented each mode for implementing his invention by models in clear pursuit of optimum engineering regards the locational placement of any means, including the termini of means, upon a cigarette. This it will further be seen has been done with full disclosure of the applicant's knowledge or understanding of the habits and idiosyncracies of smokers in general and in result of the applicant's intensive and extensive study, observation and analysis of same. Thus the applicant's renderings of devices delivering his concept in the disclosure embrace locational specifications and limits which should be understood as more precise than the concept itself, such an employ being with view toward rendering the invention conceptually clear and with view toward enabling any who will employ the invention to manufacture the invention according to its best attainable standard, such being the conscionable duty of an inventor in disclosing his invention. It will also be apparent that no inventor, nor this applicant, will in the claims restrict his entire inventive concept to the precise limitations of optimum engineering, where departure therefrom may still be adoptive of the invention in its novel principle and concept, including object, and merely reflective of the adopter's particular judgement or preference. The claims therefore it will be understood must define the invention in language definitive by construction and not limited to precise or preferred measurements, as it is apparent an inventor would not have his property negatived by mere inept or elective adaptation, such that a manufacturer will be seen to employ "means within the finger hold section of a cigarette" if he appropriates device of the invention which he shall substantially so locate, notwithstanding the fact he may fail to utilize the applicant's best disclosure recommendation which urges that anti-slippage means within a cigarette's finger hold section should be applied over all the finger hold section not just a portion of it. Similarly, the applicant's disclosure that Preventive Section means against forward finger edge slippage should be limited to a point not rearward of line 15 in FIG. 2 is clearly the applicant's intent to provide optimum instructions for best manufacture and is not intended to limit the inventive concept. Line 15 as depicted in FIG. 2 on the 84 millimeter cigarette shown is precisely 1¾" forward of the cigarette's inhaling end and according to the applicant's informed and best study of cigarette smokers 1¾" IS the least removed distance from the inhaling end of a cigarette that should characterize a means forwardly located for ARREST of forward finger edge slippage in the light and pursuit of best engineering known to the applicant. Yet if a manufacturer shall place a ring of convex blisters circumferentially around an 84 millimeter cigarette at a distance 1½" from its inhaling end, or if he shall place a narrow strip of frictionalized paper therearound, it is apparent said ring or strip will operate for forward arrest of any finger edge slippage commenced rearward of it, and it is quite constructible, therefore, the manufacturer considers an area rearward of 1½" from its inhaling end to be essentially the finger hold section of his cigarette and that he is (accordingly) locating a slippage barrier forwardly of his cigarette's (constructive) finger hold section, all of which is within the intended scope of the invention notwithstanding departure from best measurements recommended. It will therefor be understood the claims will define the invention by concept and necessary reciprocal relationships, not in enforced observance of every preferred specification giving example in the disclosure.

In the claims, "essential end to end homogeneity of shape" relates to accomplishment of the invention's prime objects without essential loss of a cigarette's traditional shaft-like conformation, an object of the invention which will be found inherent the character of all means presented in this disclosure. Outside the scope of this invention also is any device requiring any manipulation of the smoker in accomplishment of a stated object, as accomplishment of object without volition of the smoker is itself an object of this invention.

What is claimed is:

1. A cigarette wherein the improvement comprises means for discouraging the smoking of said cigarette beyond a predetermined point, said means comprising at least one hole in said cigarette's original enwrapment paper, said hole being located intermediate the ends of said cigarette's shaft and being of sufficient impairment to the cigarette's smokability as to discourage smoking of the cigarette when said hole shall be uncovered and exposed, said hole being covered and unexposed at manufacture by a spirally winding narrow band of second layer enwrapment paper restoring smokability of the cigarette, said band being secured to the cigarette only at its rearwardmost and forwardmost termini such that when the burn of the cigarette shall reach the forwardmost terminus of said band said band, its forwardmost anchorage to the cigarette being then destroyed and removed, shall then recoil and unwind rearwardly, thus exposing said hole in said original enwrapment paper and causing said cigarette to be no longer a satisfactory article for smoking, said forwardmost terminus of said band being located on the cigarette at a point, removed from said cigarette's inhaling end by distance equal to at least ½ said cigarette's total length and removed from said cigarette's lighting end by distance equal to at least ⅓ said cigarette's total length.

2. A cigarette comprising a finger well, said finger well formed by two annularly running rises on the shaft of said cigarette, one said rise being located 13 to 20 millimeters forward of said cigarette's inhaling end and the other rise being located between 45% and 60% but not more than 54 millimeters forward of said cigarette's inhaling end; each of said rises ranging annularly over at least two thirds of the circumferential arc of the cigarette; said rises being imobile and combustible so as to allow for the normal smoking of said cigarette; said finger well integral part of said cigarette, essentially undetachable therefrom and effective to be resistant to forward finger slippage.

3. A cigarette comprising a discretely altered surface on and along the wrapper of said cigarette, said altered surface comprising a multitude of irregularities that protrude from the wrapper of said cigarette, giving said altered surface a character of roughness compared to other wrapper portions of the cigarette; said altered surface having rearward terminus approximately 13 to 20 millimeters forward of said cigarette's inhaling end and forward terminus not less than 45% forward of said cigarette's inhaling end; said altered surface ranging annularly over at least two thirds of the circumferential arc of the cigarette; said altered surface being immobile and combustible so as to allow for the normal smoking of said cigarette, essentially undetachable therefrom and effective to be resistent to forward finger slippage.

4. The cigarette of claim 3 wherein said irregularities comprise irregular, widely spaced frictionalization, said irregularities being spaced in variant distances and directions one from another.

5. A cigarette having a middle area containing the rearwardmost terminus of an altered wrapper surface; said middle area beginning not less than 45% forward of said cigarette's inhaling end and ending not more than 60% nor more than 54 millimeters forward of said cigarette's inhaling end; said altered wrapper surface running transversally of said cigarette's inhaling end; said altered wrapper surface running transversally of said cigarette's shaft and ranging at least two thirds of said shaft's arc of circumference; said altered surface comprising at least one irregularity interrupting the longitudinal planes of said shaft at a plurality of annular points; said altered surface being immobile and combustible so as to allow for the normal smoking of said cigarette; said altered surface being more resistant to forward finger slippage than any more rearwardly located surface of said cigarette; said altered surface being integral part of said cigarette and essentially undetachable therefrom.

6. The cigarette of claim 5 wherein said surface irregularity comprises at least one recessed area running annularly, the longitudinal extension of any single recess being at least three millimeters.

7. The cigarette of claim 5, wherein said surface irregularity comprises at least one raised area running annularly.

8. The cigarette of claim 5 wherein said surface irregularity comprises at least one series of discrete pebble-like blisters ranging in annular line along the outermost surface of said cigarette's shaft and within the critical section bounded in the claim, number of blisters in any series being any functional quantity more than two.

9. The cigarette of claim 5 wherein said altered surface comprises a frictionalized surface of a texture selected from the group consisting of art paper, blotter paper, uncalendared paper and sandpaper.

10. A cigarette comprising an altered surface on and along the wrapper of said cigarette; said surface being tacky but nonadhesive and ranging not less than two thirds of said cigarette's total arc of circumference; said surface having rearward terminus approximately 13 to 20 millimeters forward of said cigarette's inhaling end and forward terminus not less than 45% forward of said cigarette's inhaling end; said surface being combustible so as to allow for the normal smoking of said cigarette; said surface being more resistant to longitudinal finger slippage than any more rearwardly located surface of said cigarette.

11. The cigarette of claim 10 wherein said tackified surface carries a mild stickiness typified by postage stamps.

12. A cigarette having a middle area zone containing the rearwardmost terminus of an altered wrapper surface; said zone beginning not less than 45% forward of said cigarette's inhaling end and ending not more than 60% nor more than 54 millimeters forward of said cigarette's inhaling end; said altered wrapper surface ranging at least two thirds of said cigarette's arc of circumference; said altered wrapper surface being tacky but nonadhesive and extending longitudinally a distance of at least three millimeters; said altered wrapper surface being more resistant to forward finger slippage than any more rearwardly located surface of said cigarette and being combustible so as to allow for the normal smoking of said cigarette.

13. The cigarette of claim 12 wherein said tacky but nonadhesive wrapper surface comprises a section of paper softened by a coating of glycerine.

14. The cigarette of claim 12 wherein said tacky but nonadhesive wrapper surface comprises a section of paper made minimumly sticky by a light coating of corn syrup.

15. The cigarette of claim 12 wherein said tacky but nonadhesive wrapper surface comprises a section of paper given a sizing increasing its outermost porosity.

16. A cigarette comprising a liphold section coated with a 41 Baume sodium silicate diluted with water, said silicate employed in an effective amount so as to impart to the liphold section of a cigarette a glassine-like surface substantially slicker that the remaining surface of the cigarette.

17. A cigarette comprising a rod of tobacco and a burn barrier located within the rod and defining a burn barrier zone; said burn barrier being located such that said tobacco abuts each side of said burn-barrier zone; said burn barrier comprising an intermix of tobacco and an effective amount of material characterized by its nontoxic quality, its relative incombustability and its sufficient expandability under heat so that, under full contac with a cigarette's burn, said material will not combust but will swell and expand so as to extinguish the cigarette.

18. The cigarette of claim 17 wherein said material comprises a selection from the group consisting of rice, unpopped popcorn kernels, baker's yeast, granulated gelatin.

19. A cigarette comprising a rod of tobacco and a burn barrier located within the rod and defining a burn barrier zone; said burn barrier being located such that said tobacco abuts each side of said burn barrier zone; said burn barrier comprising an intermix of tobacco and a suitable proportion of water based solid particles, said particles stable at all ordinary environmental temperatures but fully fusible at any temperature resulting from tangency with the burn of a lighted cigarette so that said particles in fusing upon contact with the burn of said cigarette will therebye extinguish it.

20. The cigarette of claim 19 wherein said water based solid particles are a compound of water with sodium silicate employed as retaining agent.

* * * * *